US007839351B2

(12) United States Patent
Schadler et al.

(10) Patent No.: US 7,839,351 B2
(45) Date of Patent: Nov. 23, 2010

(54) ANTENNA SYSTEM AND METHOD TO TRANSMIT CROSS-POLARIZED SIGNALS FROM A COMMON RADIATOR WITH LOW MUTUAL COUPLING

(75) Inventors: John L. Schadler, Raymond, ME (US); Andre Skalina, Portland, ME (US); Richard I. Bibber, Gray, ME (US); Jeffrey M. Brown, Windham, ME (US)

(73) Assignee: SPX Corporation, Charlotte, NC (US)

( * ) Notice: Subject to any disclaimer, the term of this patent is extended or adjusted under 35 U.S.C. 154(b) by 945 days.

(21) Appl. No.: 11/698,065

(22) Filed: Jan. 26, 2007

(65) Prior Publication Data

US 2007/0254587 A1 Nov. 1, 2007

Related U.S. Application Data

(60) Provisional application No. 60/791,887, filed on Apr. 14, 2006.

(51) Int. Cl.
*H01Q 1/12* (2006.01)
*H01Q 11/12* (2006.01)
*H01Q 21/26* (2006.01)

(52) U.S. Cl. ..... 343/890; 343/742; 343/797

(58) Field of Classification Search ..... 343/742, 343/797, 890

See application file for complete search history.

(56) References Cited

U.S. PATENT DOCUMENTS

| | | | | | |
|---|---|---|---|---|---|
| 4,184,163 | A * | 1/1980 | Woodward | 343/742 |
| 4,510,501 | A * | 4/1985 | Woodward et al. | 343/742 |
| 5,751,252 | A * | 5/1998 | Phillips | 343/726 |
| 5,929,820 | A * | 7/1999 | Caulfield et al. | 343/761 |
| 6,823,177 | B1 * | 11/2004 | Lucidarme | 455/103 |
| 6,934,514 | B2 | 8/2005 | Stenberg | 455/45 |
| 7,292,195 | B2 * | 11/2007 | Phillips et al. | 343/744 |

* cited by examiner

*Primary Examiner*—Shih-Chao Chen
(74) *Attorney, Agent, or Firm*—Baker & Hostetler LLP

(57) ABSTRACT

A dual-port IBOC® antenna provides omnidirectional radiation of orthogonal, circularly polarized analog (FM) and digital (OFDM) signals using quadruple coplanar square loops driven from a hybrid having balanced outputs. The loops are arranged in a tiled square, with proximal sides functioning as further stripline hybrids to cancel cross coupling between the loops. Each loop quad is reflector-backed and emits a directional signal; multiple loop quads oriented radially form an omni bay. Vertical spacing between bays includes a minimum position for mutual coupling, while symmetry establishes uniform input impedance on the hybrid input ports. Tuning barbs on the loops fine tune frequency response. Bandwidth is wide, so that a single antenna can radiate multiple FM analog and hybrid IBOC® channels over the VHF FM radio broadcast band.

23 Claims, 14 Drawing Sheets

ANTENNA SYSTEM AND METHOD TO TRANSMIT CROSS-POLARIZED SIGNALS FROM A COMMON RADIATOR WITH LOW MUTUAL COUPLING

CLAIM OF PRIORITY

This application claims priority to a U.S. provisional application entitled, "Antenna System and Method to Transmit Crossed Polarized Signals from a Common Radiator with Low Mutual Coupling", filed Apr. 14, 2006, having Ser. No. 60/791,887, which is hereby incorporated by reference in its entirety.

FIELD OF THE INVENTION

The present invention relates generally to radio broadcasting. More particularly, the present invention relates to dual-feed antennas for simultaneous transmission of digital signals and analog signals in the same band and on the same assigned channel (In-Band, On-Channel, or IBOC®, is a registered trademark of iBiquity Digital Corporation).

BACKGROUND OF THE INVENTION

The Federal Communications Commission (FCC) controls broadcasting rules for the United States, specifically including the properties of broadcast signals for radio and television, in coordination with the International Telecommunications Union (ITU). For television, broadcast emission is limited to a single predominant linear polarization and a single predominant circular polarization. For audio broadcasting (radio), a Very High Frequency (VHF) band from 88 MHz to 108 MHz is assigned for transmission of (analog) Frequency Modulated (FM) signals. The band, with reference to its frequency range rather than any specific modulation technology, is referred to herein as the FM band. "Channels," as referred to herein, are the one hundred channels, centered at 200 KHz intervals, specified by the FCC, wherein modulation of +/−75 KHz is defined as 100% modulation, wherein output deviating from the center frequency by +/−120 KHz to +/−240 KHz is required to be 25 dB below the level of the unmodulated carrier, and wherein output deviating from the center frequency by +/−240 KHz to +/−600 KHz is required to be 35 dB below the level of the unmodulated carrier. As these requirements make evident, gaps between channels are controlled by modulator and filter rolloff rather than by assignment of forbidden zones.

Broadcasters in the FM band are permitted to radiate with horizontal (linear) as well as left-hand and right-hand circular/elliptical polarization (FCC regulations, 47 CFR §73.316 et seq.). The Medium Frequency (MF) broadcast band from 535 KHz-1605 KHz uses Amplitude Modulated (AM) signals, and is referred to herein as the AM band, again with reference to frequency rather than modulation technology. AM radio uses somewhat different rules and is not addressed by this invention.

FIG. 1 shows a spectrum mask 10 of allowable power versus frequency for a broadcast channel, wherein a center frequency $F_0$ 12 is one of the FCC-defined FM-band analog channel center frequencies, and lower and upper frequency mask 10 limits $F_{LO}$ 14 and $F_{HI}$ 16 represent the −25 dB extremes described above. Signal strength of a realizable analog FM transmitter will ordinarily have an envelope 18 of power as a function of deviation from the center frequency. To each side of the first threshold of the spectrum mask 10 are groups 20 made up of multiple digital subchannels 22. These fall within FCC regulations, and contain the digital portion of IBOC® broadcasting. Total energy in each group 20 is specified to be 20 dB below the total analog envelope energy.

IBOC® is transmission of a digital signal or of an analog signal and a digital signal simultaneously on a single assigned channel within the AM or FM band. The signal in the analog envelope 18 in the FM band is frequency modulated. The lower and upper digital subchannels 20 are orthogonal frequency division multiplexed (OFDM) data streams that may include information such as the audible content of the analog FM signal, channel pilot tones, ancillary data such as program text, and such other information as a broadcaster may choose to transmit. The digital subchannels 22 contain appreciable energy only outside the −25 dB limits of the analog energy mask 10 specified for the channel.

IBOC® digital signal energy falls generally within the bandwidth of FM band analog broadcast antennas. It is possible to cobroadcast the analog and digital content using a single transmitter, transmission line, and antenna, but may be difficult for multiple reasons, including the bandwidth of existing high-power (vacuum tube) analog-only transmitters and the power output of existing (solid state) wide-bandwidth transmitters. Strategies for circumventing these limitations include combining the output of multiple (lower power) cobroadcasting-capable transmitters, combining separate analog transmitter and digital transmitter output signals, and numerous others.

Licensing of broadcasting is restrictive, with rules defining signal bandwidth and purity (out-of-channel and other harmonic energy), signal strength as a function of distance from a broadcast antenna, direction of emission, height from which emission occurs, and the like, as well as content.

Antennas can be single dipoles or any other styles that satisfy regulations and meet broadcasters' requirements. Many antennas are composed of multiple radiating elements, with each element or group of elements occupying a so-called bay, that is, a vertical location along an antenna tower, with the bays spaced apart by distances that may approximate a half-wavelength or one wavelength of the signal center frequency for which the antenna is designed. An antenna can be defined as an assemblage that includes a number of bays distributed over an aperture, wherein the aperture as used herein is the distance from the topmost to the bottommost extent of the radiating elements. One effect of using an extended aperture, realized in some embodiments with multiple bays, is to increase gain, that is, to reinforce emission in a main beam in the shape of a flattened torus surrounding the antenna (uniformly if omnidirectional) and to partially cancel and thus suppress emission above and below the main beam. The main beam can be deflected toward or away from the ground by adjusting interbay spacing as compare to the nominal half- or full-wavelength spacing, a principle termed beam tilt. Broadband antennas, defined herein as those which can emit efficiently for several channels, have interbay spacing selected for a particular frequency (in effect, a single channel) within the antenna bandwidth, with other channels typically exhibiting somewhat reduced gain and different beam tilt.

Antennas can achieve output signal polarization by structure and orientation of elements and by interaction of elements. For example, a single, vertically oriented, free-standing, center-driven dipole emits, by default, a vertically polarized, omnidirectional signal with strength approximately toroidal with azimuth and elevation. By contrast, a vertical slot antenna center-driven between the edges of the slot emits a horizontally polarized signal, generally in a single predominant azimuthal direction, such as with a skull or cardioid pattern of signal strength in both azimuth and elevation.

A circularly polarized signal can, like a linearly polarized signal, be emitted in multiple ways. (Note: circular polarization (CP) is the limit of elliptical polarization, at which limit signal magnitude is substantially equal at all angles. As used herein, CP is a shorthand term for all rotating polarizations. Ghost rejection, like the characteristic 3 dB gain reduction from use of a linearly polarized receiving antenna and the jagged boundary of magnitude with angle, is an attribute of CP broadcasting not further addressed herein.) Ways for emitting CP include forcing a signal to propagate with CP by exciting two or more radiators with the same signal, but with different phase delay, which can produce CP as measured at far field. Antenna elements designed for this can be electrically symmetrical, permitting the phase of the applied signals to determine whether the emitted signal is linearly polarized or is left- or right-hand-circularly polarized. Thus, in particular, by splitting a signal, delaying half of it for a specific time, and applying it to specifically-oriented and -spaced components of an antenna element, a first circular polarization can be achieved, while an equivalent signal, split similarly but delayed oppositely, can achieve opposite circular polarization simultaneously from the same antenna element.

As shown schematically in FIG. 2, one prior-art approach to combining analog and digital FM band signals for IBOC® has been to feed analog 24 into one input port 26 of a 3 dB hybrid 28 and digital 30 into the opposite input port 32. As is well known in the art, a transmission line-compatible hybrid 28 of the type shown, variously known as a 3 dB, 90 degree, or quarter-wave coupler or hybrid, accepts one or two input signals on ports assigned as input ports 26 and 32, respectively, and emits output signals on the remaining two ports 34 and 36. The split signals on the respective output ports 34 and 36 are phased in such a way that a suitable antenna element, such as the crossed dipole pair 38 in FIG. 2, emits in the out-of-the page direction with right hand polarization 40 for one signal and left hand polarization 42 for the other signal.

As shown in FIG. 3, it is well known in the art that when dipole radiators are placed in an orientation other than orthogonal to one another, they will mutually couple energy, a process that increases with proximity as well as with the extent of parallelism. Each dipole serves as both a transmitter and a receiver for energy to and from the other dipole. It follows that when coplanar dipoles 44, 46 are placed in a crossed configuration, having an angular difference $\theta$, they will exhibit cross coupling in proportion to the extent to which the dipoles are nonorthogonal, that is, that the angle $\theta$ differs from 90 degrees. Thus, cross coupling in FIG. 3 increases with a first polarity as $\theta$ decreases from 90 degrees toward zero, and increases with a second polarity, opposite to the first polarity, as $\theta$ increases from 90 degrees toward 180 degrees. If the dipoles 44, 46 are noncoplanar, the effect is diminished but not eliminated.

As shown in FIG. 4, and as is well known in the art, it further follows that when crossed dipole elements 44, 46 are part of a vertical array of such elements 48, mutual coupling will occur from bay 50 to bay 50 in proportion to the closeness of interbay spacing and the parallelism of corresponding dipoles in the respective bays 50.

As shown in FIGS. 5 and 6, and as is well known in the art, the effects of mutual and cross coupling can be seen in the antenna's overall impedance, with the magnitude and the phase of intercomponent coupling changing the input impedance of each dipole 44, 46. A single pair of crossed dipoles in free space, driven from a hybrid 28, as shown in FIG. 5, has characteristic impedance that can be represented on the respective ports' Smith charts 52 and 54.

For two pairs of crossed dipoles, as shown in FIG. 6, interaction between the corresponding dipoles in the pairs becomes a factor. If the output ports 34, 36 of the respective hybrids 28 feed the respective dipoles 44, 46, and if the phase delay from the respective analog input ports 26 to the output ports 34, 36 is opposite to the phase delay from the respective digital input ports 32 to the output ports 34, 36, as would be expected with a typical 3 dB hybrid 28, then there is a 90 degree phase difference in the mutual coupling effect between the dipoles 44, 46. This in turn causes a difference in input impedance between the dipoles 44, 46, creating a shift in input impedance at the input ports of the respective hybrids 28. This difference is represented in FIG. 6 by the difference between the respective ports' Smith charts 52 and 54.

FIG. 7 shows an antenna 60 having two sets of crossed dipoles 62 and 64, respectively, fed by hybrids 66 and 68, respectively, wherein the lower hybrid 66 is shown as driven and the upper hybrid 68 is examined for its properties. As shown in FIG. 7, corrections can be made to one set of dipoles 56, 58—here, dipoles 56 are lengthened—to compensate for the impedance shift into one of the hybrid input ports of the upper hybrid 68. In this example, the upper input port 38 is successfully compensated by the lengthened dipoles, despite the presence of the lower element 62. However, this compensation comes at the expense of making the match worse into the lower input port 32. In the prior art, this practice was common and practical, since only one of the two input ports 32 or 38 was usable. In FIG. 7, respective dipoles 56 of the elements 62 and 64 are made longer in order to make their impedance in the presence of mutual coupling the same as the impedance of an equal-length set of dipoles in free space. As shown, this compensation technique only works with respect to one input port 38 of the affected hybrid 68. The opposite input port 32 exhibits twice the shift in input impedance, with that shift in the opposite direction, which only matters if the other input port 32 is used. Thus, this type of antenna cannot be used as a dual input design unless the radiating elements are symmetrical, which requires that both mutual and cross coupling be eliminated; as derived here, this is clearly infeasible with the simple dipoles shown in FIG. 7.

The radio industry and the FCC have standardized on the iBiquity® IBOC® hybrid analog-digital transmission system. FM stations in the U.S. are permitted to simultaneously broadcast analog and digital signals within their current allocated frequency range. One method of achieving the simulcast is to use two separate transmission systems driving two separate antennas, with the antennas isolated sufficiently, such as by spatial separation, to produce minimal interaction. Another simulcasting method uses a hybrid-fed, crossed-dipole configuration, wherein the analog and digital signals are fed into the zero- and 90-degree ports of the hybrid, producing right-hand analog and left-hand digital polarization from the single antenna. U.S. Pat. No. 6,934,514 discloses an embodiment of this method. This method inherently includes cross coupling between dipole components within each element and mutual coupling between corresponding components in different antenna bays. With existing designs, the compensation required to neutralize the coupling into one hybrid input port adversely affects the opposite input port, so that a good match cannot be achieved into both input ports simultaneously. This can limit performance of this design in a dual-input antenna configuration.

SUMMARY OF THE INVENTION

The foregoing disadvantages are overcome, to a great extent, by the present invention, wherein an apparatus and method are provided that in some embodiments provide a dual-input crossed dipole antenna that substantially eliminates mutual coupling between the bays of a circularly polarized crossed dipole array, whereby an analog-digital combining method can be realized.

In accordance with one embodiment of the present invention, a two-port electromagnetic signal broadcasting antenna is presented. The antenna includes a first radiating element, a hybrid coupler having a first unbalanced input port and a second unbalanced input port, and having a first balanced output port and a second balanced output port, wherein the respective balanced output ports have respective output signal conductor arrangements configured to supply substantially equal and opposite signals from the hybrid coupler to a balanced load. The antenna further includes electrical connections between the first radiating element and the respective output signal conductors of the hybrid coupler, wherein points of connection between the first radiating element and conductors are substantially symmetric about the rotational axis of symmetry of the first radiating element arrangement.

In accordance with another embodiment of the present invention, an antenna is presented. The antenna includes a first dipole that includes two first monopoles, and a second dipole that includes two second monopoles, wherein the two first monopoles are coupled with the two second monopoles using stripline hybrid couplers, wherein component elements comprising the stripline hybrid couplers are integral with the respective monopoles, and wherein the two dipoles form a crossed dipole radiator.

In accordance with yet another embodiment of the present invention, a two-port electromagnetic signal broadcasting antenna is presented. The antenna includes means for radiating two circularly polarized signals within a frequency band with orthogonal polarization, wherein the means for radiating emits signals having advancing orientation of signal polarization angles over time, with a first rotational direction of advance for the first signal and a second, reversed, rotational direction of advance for the second signal, wherein the means for radiating exhibits low cross coupling between elements that make up the means for radiating, means for coupling source signals from two unbalanced inputs to two balanced outputs, wherein the means for coupling directs a first unbalanced signal from a first coaxial feed port to a first coaxial output port with a first reference delay and to a second coaxial output port with a delay exceeding the first reference delay by approximately one quarter cycle of a broadcast frequency, and wherein the means for coupling directs a second unbalanced signal from a second coaxial feed port to the second coaxial output port with a second reference delay and to the first coaxial output port with a delay exceeding the second reference delay by approximately one quarter cycle of a broadcast frequency, and means for conductively connecting the balanced outputs of the means for coupling to the elements that make up the means for radiating.

In accordance with yet another embodiment of the present invention, a method for broadcasting orthogonal circularly polarized electromagnetic signals is presented. The method includes providing a first signal and a second signal for application to a two-port broadcasting antenna, wherein the first signal comprises an analog FM VHF signal having broadcast amplitude and a specified channel frequency, wherein the second signal comprises a digital OFDM signal configured to permit cofunctioning with the analog FM VHF signal to provide emission that conforms to the standards of the IBOC® specification. The method further includes dividing each of the first and second signals into two substantially equal energy portions, wherein each signal has an energy portion with a zero reference phase, and wherein each signal has an energy portion with a phase lag that is approximately ninety degrees greater than the zero reference phase, and combining a zero reference phase energy portion of one of the signals and a ninety degree lag portion of the other signal to form a first balanced output and the remaining portions to form a second balanced output.

The method further includes configuring orthogonal, coplanar first and second crossed dipoles with cross coupling-suppressing hybrid coupling between each monopole of the first dipole and each monopole of the second dipole, and applying the first and second balanced outputs to the respective dipoles.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
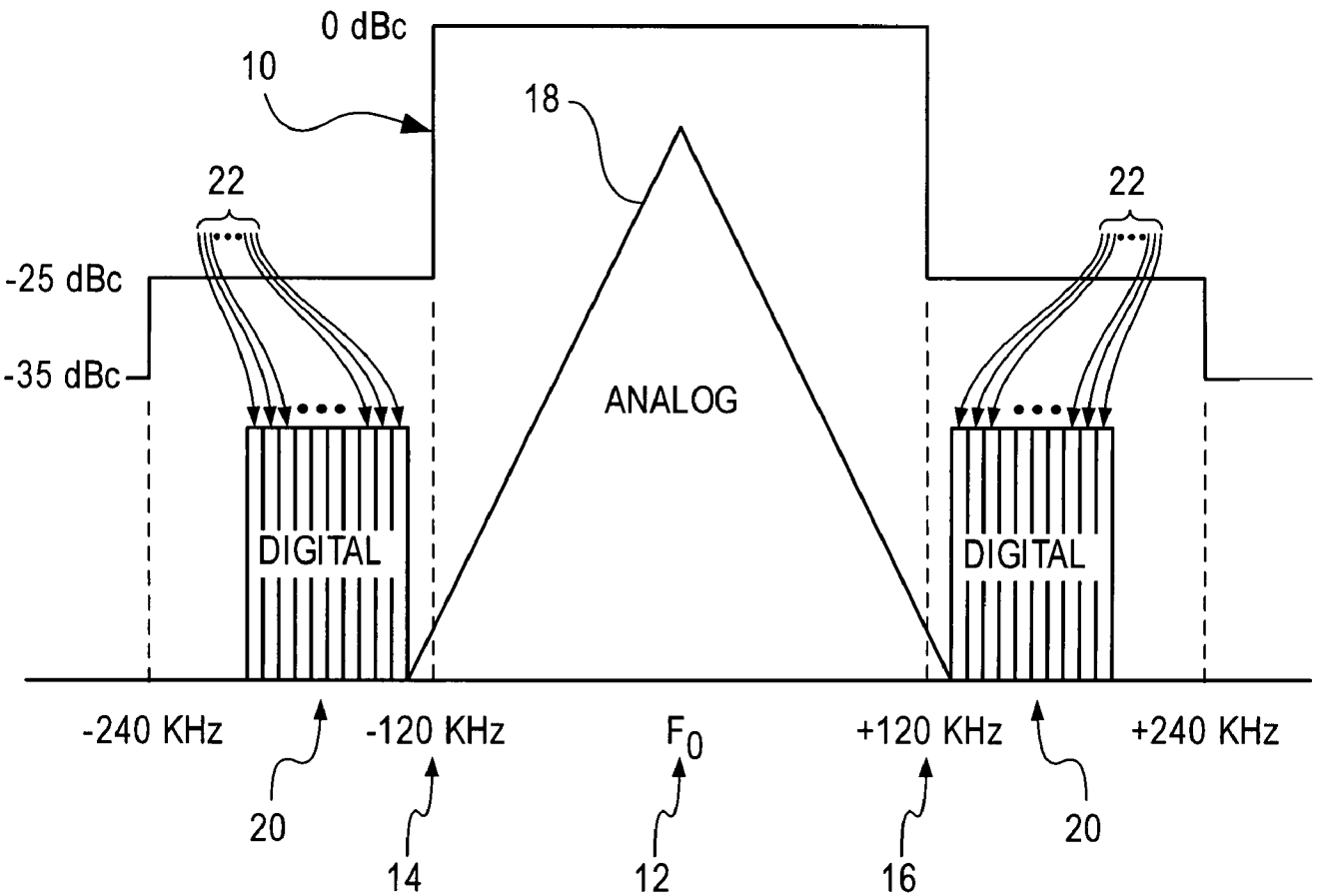
FIG. 1 (PRIOR ART)
FIG. 1 is a power spectrum diagram for IBOC® broadcast signals according to FCC standards.
Figure 2:
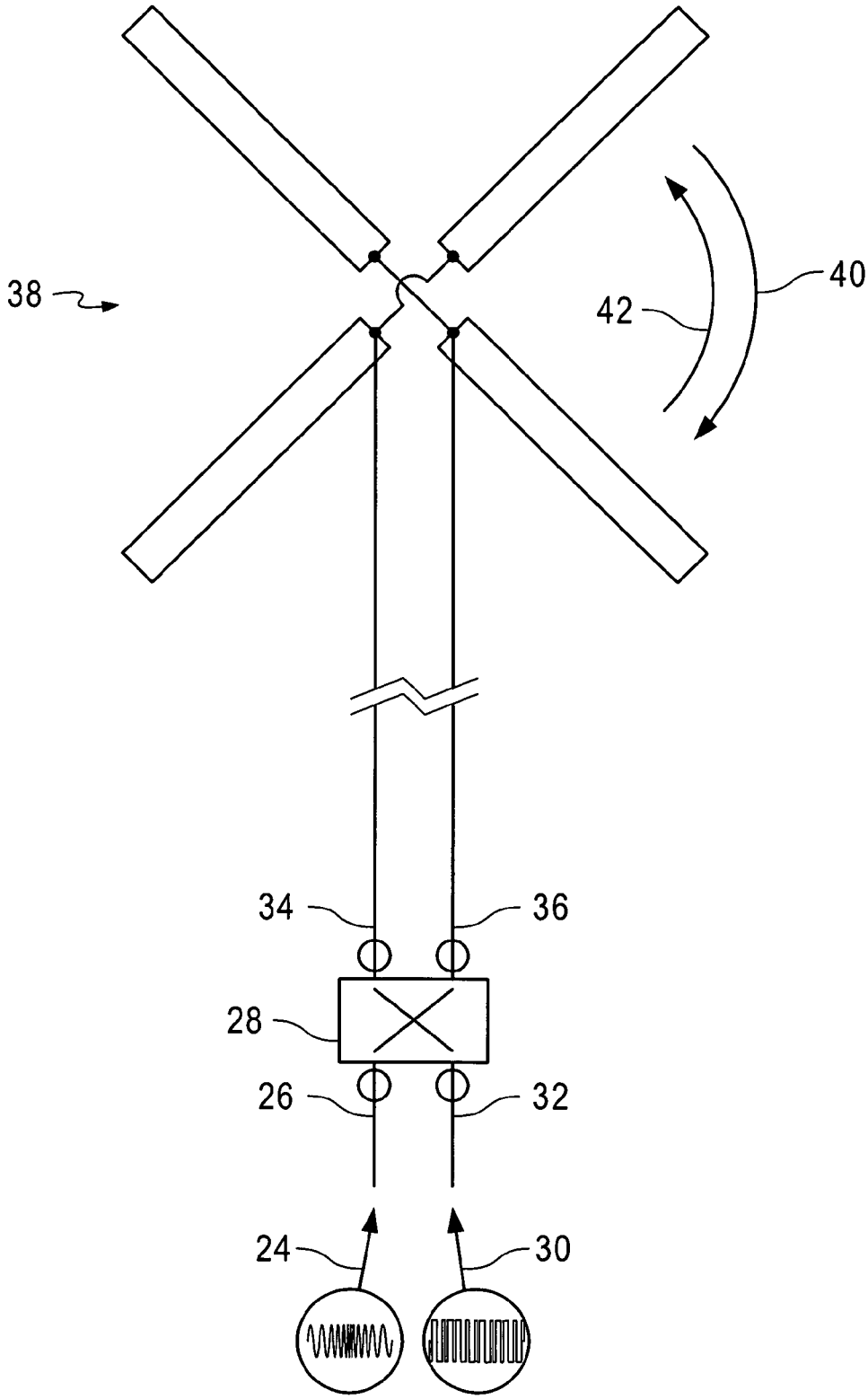
FIG. 2 (PRIOR ART)
FIG. 2 is a schematic diagram representing crossed dipoles in a system according to one embodiment of the prior art.
Figure 3:
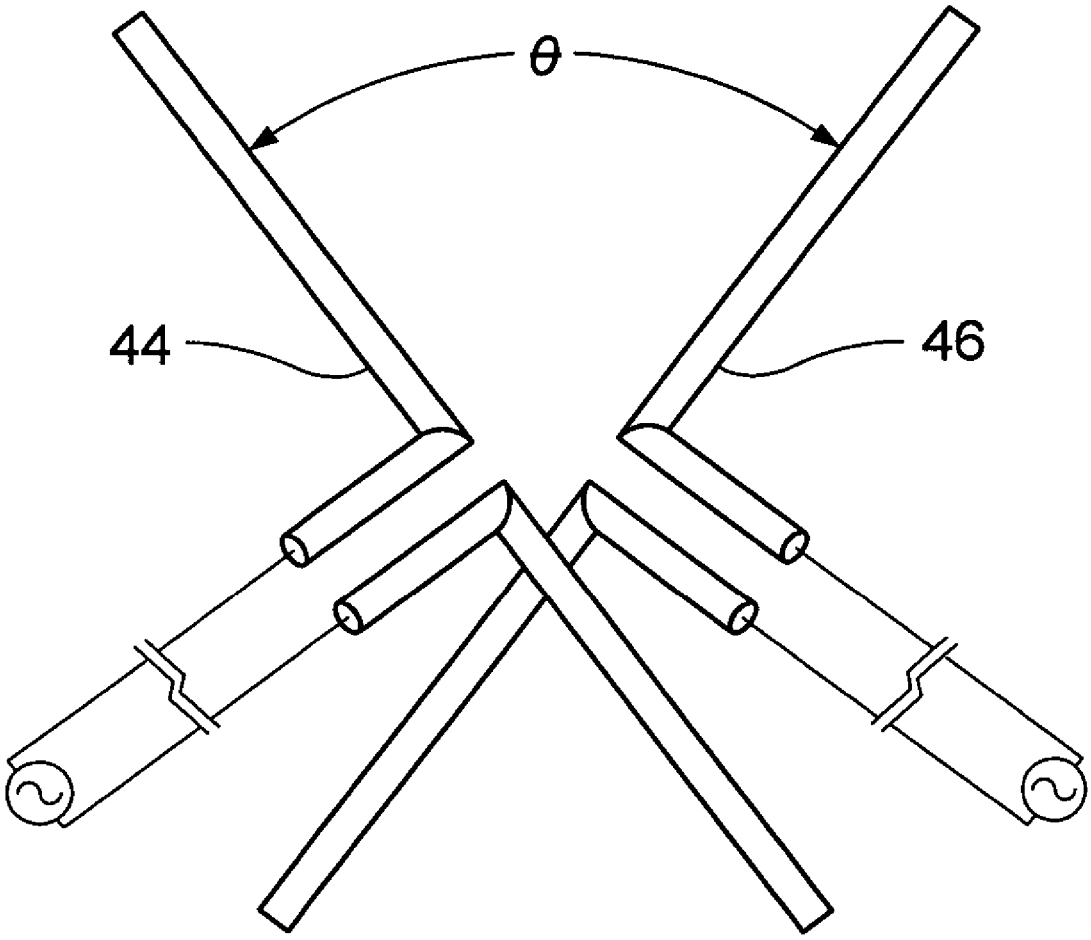
FIG. 3 (PRIOR ART)
FIG. 3 is a schematic diagram illustrating the interaction of crossed dipoles within an array element.
Figure 4:
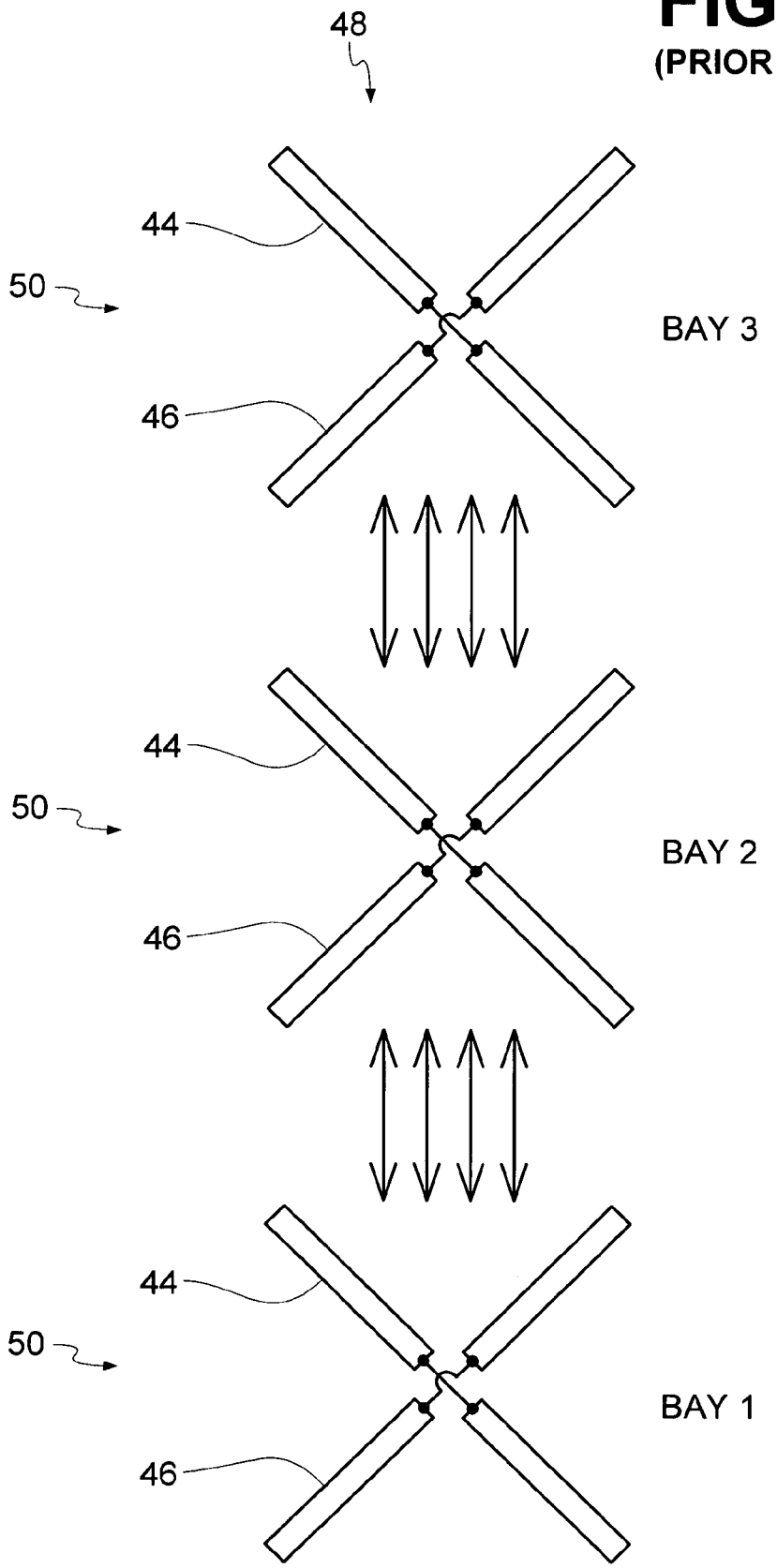
FIG. 4 (PRIOR ART)
FIG. 4 is a schematic diagram illustrating the interaction of array elements between bays of an antenna.
Figure 5:
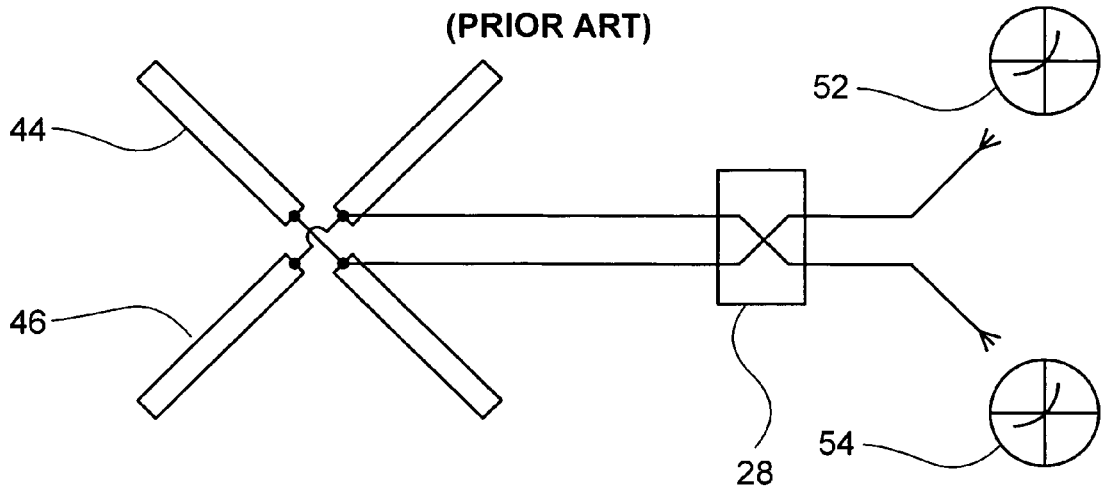
FIG. 5 (PRIOR ART)
FIG. 5 is a schematic diagram with Smith chart further presenting the properties of embodiments consistent with FIG. 4.
Figure 6:
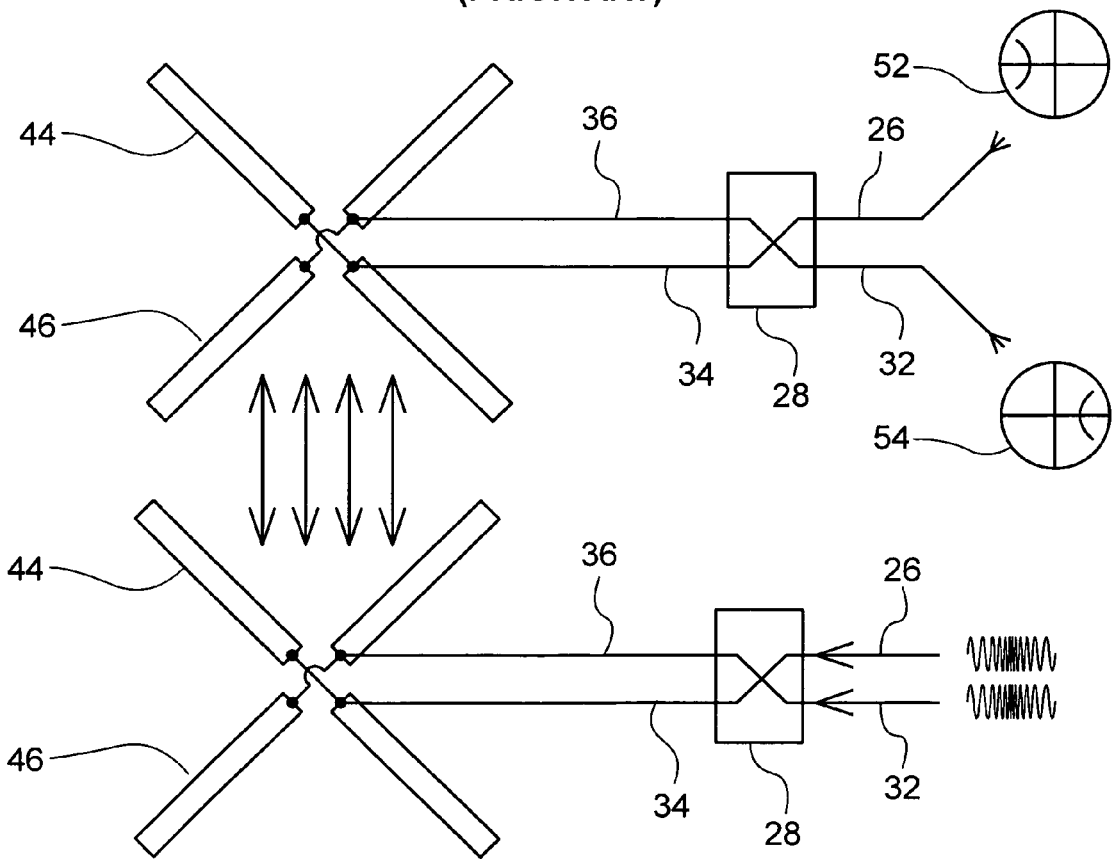
FIG. 6 (PRIOR ART)
FIG. 6 is a schematic diagram with Smith chart presenting limitations of compensation methods for embodiments consistent with FIG. 4.
Figure 7:
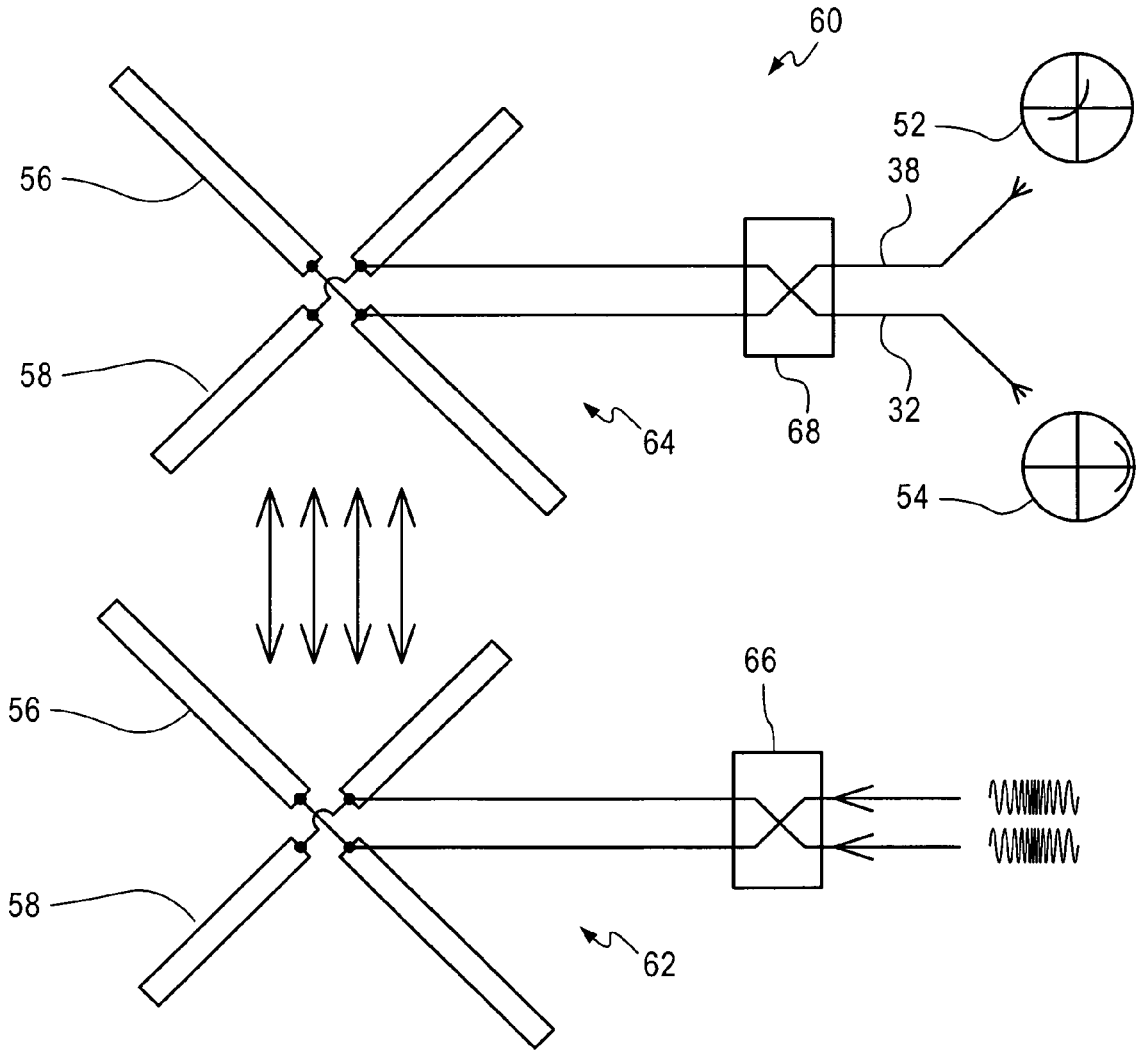
FIG. 7 (PRIOR ART)
FIG. 7 is a schematic diagram with Smith chart presenting a compensation method suitable for prior art applications but unsuitable for IBOC applications.

The invention will now be described with reference to the drawing figures, in which like reference numerals refer to like parts throughout. The present invention provides an apparatus and method that in some embodiments provides emission of cross-polarized signals from a common radiator with low cross coupling and low mutual coupling.

FIGS. 1-7 are discussed in detail in the background section, above. The prior art presented therein demonstrates that known crossed dipole practice prevents adequate, simultaneous control of mutual coupling and cross coupling in multiple-bay broadband antennas. As a result, radiation of very close frequencies from separate signal sources, such as from an analog FM transmitter and a separate, digital OFDM transmitter on the same channel, using a dual-port, crossed-dipole antenna to realize In-Band, On-Channel (IBOC®) broadcast, is infeasible according to the prior art.

This is to be understood to be distinct from known practice of transmitting multiple analog FM signals on a broadband antenna, wherein the working channels are separated by unused channels, in accordance with FCC-approved practice. In this practice, known high-power passive filters, in conjunction with realizable circulators, can block each signal from the transmitters of the others, with the out-of-band rolloff of the filters and the directionality of the circulators providing the required protection. Since IBOC® signals share a channel, with the digital portion of the signal bandwidth having negligible separation from the analog, known passive bandpass filters for the three segments of the signal for each channel would be large and costly, while circulators adequate to protect low-power OFDM transmitters from worst-case analog return energy from full-power analog transmitters are hypothetical at the time of this disclosure.

The invention configures a crossed dipole geometry in such a way that the crossed dipoles in each element (cross coupling), and the elements in adjacent bays (mutual coupling), are effectively decoupled. This can be accomplished by using pairs of crossed, right-angled, equilateral dipoles.

Figure 8:
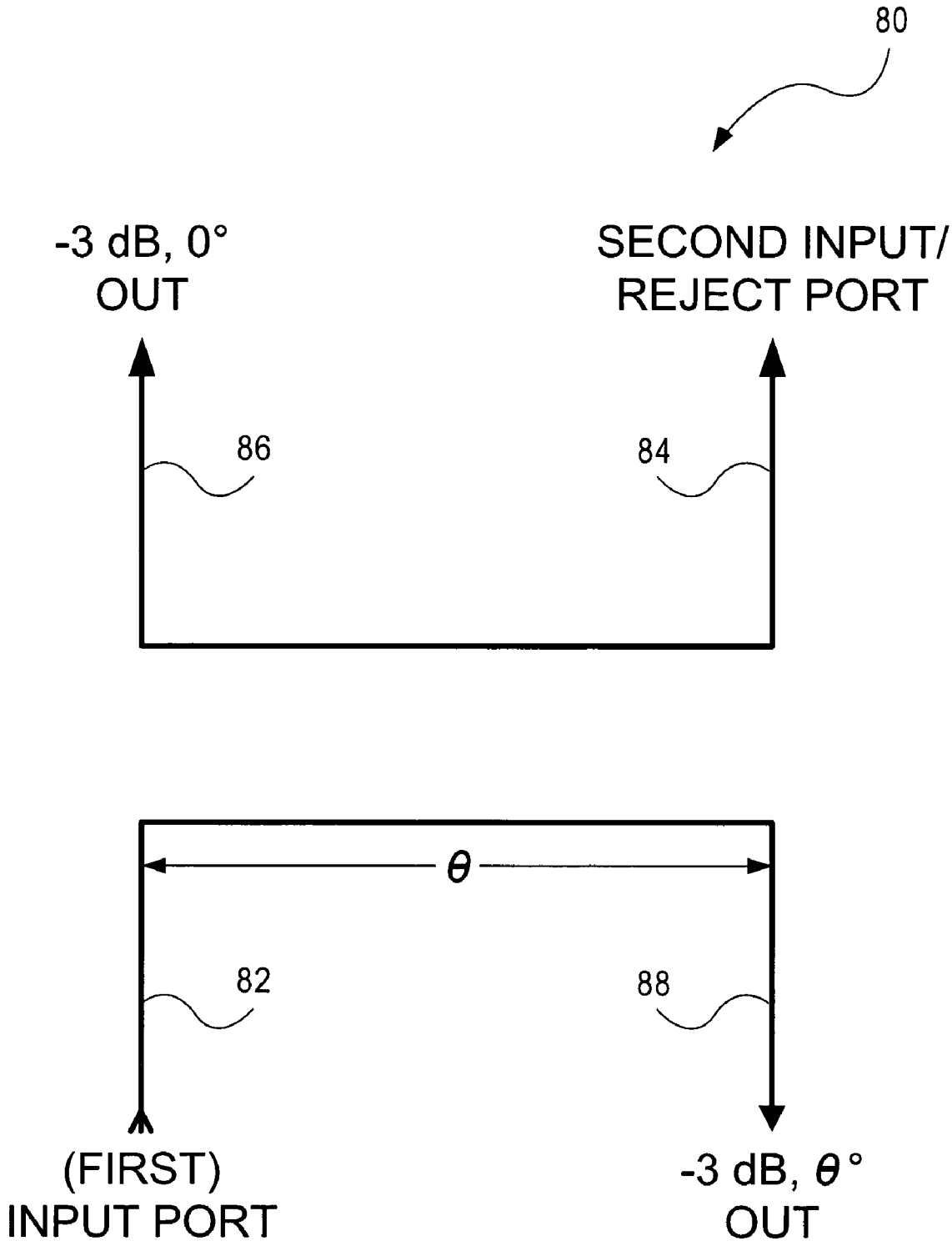
FIG. 8 (PRIOR ART)
FIG. 8 is a schematic diagram of a 3 dB (90 degree) coupler (hybrid) according to the prior art.

Directional coupler theory can be applied to show why there is no cross coupling from dipole to dipole within the same radiator for this design. FIG. 8 depicts a typical parallel transmission line-compatible non-crossover hybrid coupler 80 in schematic form. As is well known in the art, a transmission line hybrid coupler 80 of the type shown, variously known as a 3 dB, 90 degree, or quarter-wave coupler, hybrid, combiner, or splitter, as well as a hybrid coupler (depending in part on its use in an application), accepts one or two input signals on ports assigned as input ports 82 and 84, respectively, and emits output signals on the remaining two ports 86 and 88. Since hybrid couplers 80 of the types addressed here are strictly passive, and may be of symmetrical construction in some embodiments, the input and output port pairs may be interchangeable.

It may be observed that the schematic hybrid coupler 80 resembles the physical arrangement of the radiator portions of the inventive apparatus as presented in subsequent figures. The representation of FIG. 8 suggests the electrical behavior of the radiators more readily than do some other conventions. Hybrid couplers are also represented in both the prior art (FIGS. 2-7; the crossover type is shown) and elsewhere in the instant invention (below); for ease of presentation, crossover hybrid couplers are shown with inputs on a single face of the couplers, with outputs on the opposite face, and with an "X" symbol as a reminder that the ports are not arranged as in FIG. 8.

As determined by the dimensions of the hybrid—that is, the widths and lengths of the facing surfaces, the gap between the surfaces, and the dielectric constant of the gap—the outputs may be equal in magnitude and may differ by 90 degrees in phase. Equivalent response is possible with the inputs and outputs transposed; in some embodiments, the same hybrid coupler 80 could function instead as a combiner for two equal inputs that differ by 90 degrees in phase. In the hybrid coupler 80 shown, the output ports 86 and 88 each couple half of the signal applied to each input port 82 and 84 (hence the term "3 dB"), with the in-line port 86 coupling the first input port 82 with a reference amount of delay (zero phase) and the second output port 88 coupling with θ degrees more than the reference delay (phase length of θ degrees). The second input port 84, similarly, couples with reference delay (zero phase) to its proximal port, the second output port 88 as shown, and couples with θ degrees more than the reference delay to the distal port, the first output port 86 as shown.

With respect to the first input port 82 in the hybrid coupler 80 shown, coupling is understood to be either conductive, as in the distal port 88, or electromagnetic, as in the proximal port 86. Electromagnetic (EM) coupling is canceled for a port that has a signal of the same phase and magnitude present; for example, if the first input port 82 has a signal present thereon, and the EM-coupled output port receives the same signal from another source, there is no potential difference, and no basis for energy to be coupled between the components.

Figure 9:
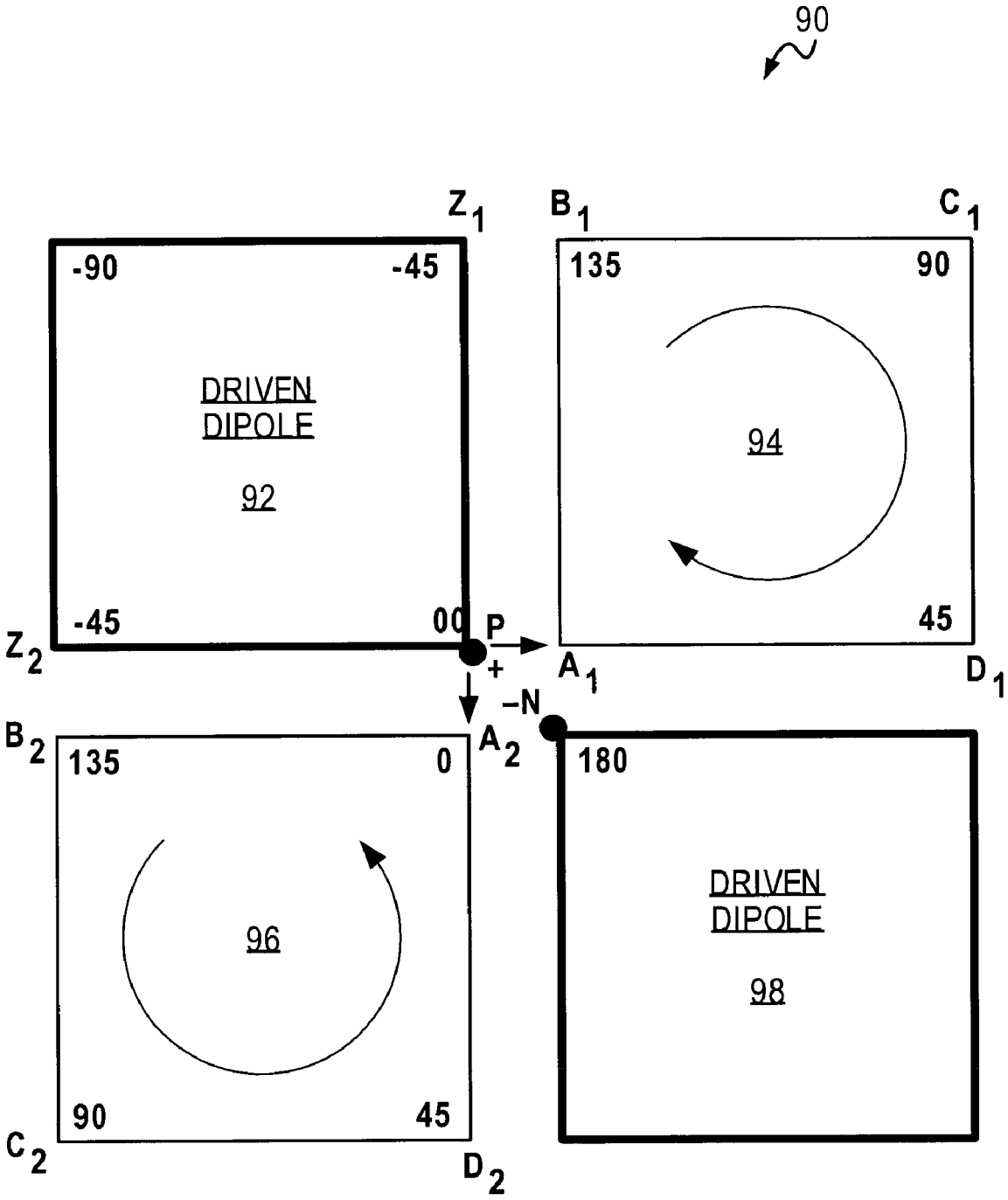
FIG. 9 is a planar view of an antenna element introducing compensation methods for embodiments according to the inventive apparatus.

FIG. 9 shows a set of radiative elements according to the inventive apparatus. For ease of presentation, only one signal is applied, and signal propagation from only one terminal of the differential pair is described in detail. In practice, the pair shown in bold (92 and 98) is driven equally and oppositely by a first signal with zero phase, while the lightly-drawn pair (94 and 96) is driven equally and oppositely by the 90 degree phase delayed version of the same signal. Simultaneously, the pairs are driven by the second signal with the phase relationship reversed. As will be shown, this results in the first signal radiating with a first circular polarization, while the second signal radiates with a second circular polarization, opposite to the first.

Figure 10:
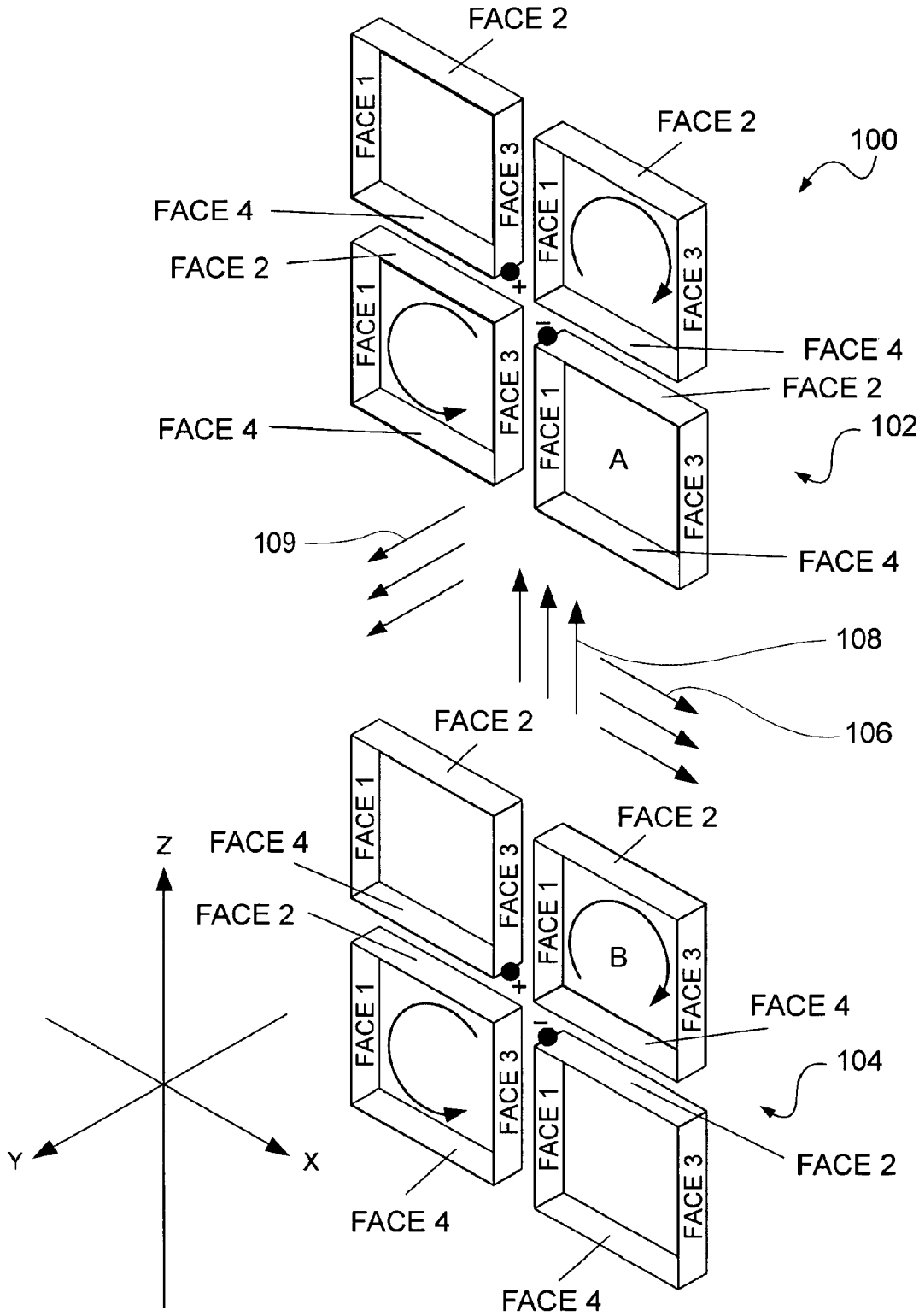
FIG. 10 is a perspective view of two antenna elements illustrating the isolation achieved using the compensation method of FIG. 9.

It can be shown that adjacent faces of square radiators (i.e., conductive material, shown here as flat strips formed into open, square loops of which the depth is the width of the strips, as further shown in FIG. 10 and successive figures) can act as directional couplers, or hybrids, each having a reject port at 135 degrees (⅜ wavelength) relative to an input port (0 wavelength), with each side of the hybrid having a phase length of θ=45 degrees (⅛ wavelength).

In FIG. 9, an antenna element (effectively a quad of hybrids) 90 has four square-loop components making up crossed dipoles. Two diagonally opposed square components 92 and 98 are driven at points P(+) and N(−), respectively, with a 0 and 180 degree relationship (½ wavelength—equal and opposite signals). If point P is a first input to the element 90, a signal applied to point P may be assigned a zero phase. At the instant at which the zero phase signal is present at point P, the phase at points $Z_1$ and $Z_2$ is −45 degrees; this is the signal from ⅛ cycle ago, and has propagated along the face of the driven component under consideration. The hybrid model of FIG. 8 shows this as the −3 dB θOUT point, with θ at (−)45 degrees. At the same instant, consistent with the hybrid model of FIG. 8, the points directly across from the $Z_1$ and $Z_2$ points, here labeled $B_1$ and $B_2$, respectively, corresponding to reject ports, are at +135 degrees with respect to the point P. The still earlier points, $C_1$ and $C_2$, are at 90 degrees, points $D_1$ and $D_2$ are at 45 degrees, and points $A_1$ and $A_2$ are at zero degrees—that is, in phase with the input port P(+). Thus, no potential exists between point P and the points A, and the signal at point P is not coupled. This is true for each of the four directional couplers created between the square dipole components 92, 94, 96, and 98 with respect to all of the others. Since no voltage is induced at the feed point of any one component from any other one, no cross coupling exists.

In order for the above condition to be realized, it is necessary that the individual conductive components have perimeter lengths approximating one-half wavelength of a frequency of interest, where a frequency of interest may be the center frequency of a frequency band for a broadband antenna. It is further necessary that the components have properties of striplines—that is, that the facing widths of the conductors and the spacing therebetween, as well as conductivity and dielectric properties, have values that establish the desired energy and time coupling. Finite element analysis (FEA) functions from ordinary antenna design software permit ring dimensions and spacing to be established to an acceptable first approximation, with verification of prototype hardware used to adjust for any residual error. As discussed below, tuning barbs may be added to achieve optimum performance.

Loop antenna theory can be applied to illustrate why there is very little mutual coupling from one radiator bay to the next in apparatus incorporating the instant invention. In FIG. 10, two bays of an antenna 100 are depicted as a two-dimensional array of loop elements lying in the indicated XZ plane. The only signal component that can couple appreciably from loop A 102 to loop B 104 is the horizontal component 106, since the loops include proximal segments parallel to this component. (Note that the propagating horizontal current component 106 in loop A induces a field around the conductor FACE 4 of loop A, which couples to conductor FACE 2 of loop B, where it in turn induces a current.) Vertical signal component 108 tends to induce fields that do not couple efficiently between the loops, while transverse signal component 109 is not oriented to form magnetic field loops and thus couples minimally. Loop FACE 1 and FACE 3 are transversely oriented with respect to the horizontally polarized wave component; as a consequence, no currents are induced in these faces. The only current that can couple between bays occurs between FACE 4 of the upper loop and FACE 2 and FACE 4 of the lower loop. Because the propagating field from loop A reaches FACE 2 before it reaches FACE 4, a voltage differential is present, and a current can be induced in loop B. The differential voltage induced between FACE 2 and FACE 4 is proportional to the distance between the respective faces.

As developed above, the areas of the respective loops represent a controlling factor in mutual coupling between bays. By assigning a loop size that is small in wavelengths compared to the spacing between loops, mutual coupling can be kept low. Thus, loop face (perimeter) length is a controlling dimension in both cross coupling and mutual coupling.

Optimization is in part analytic and in part experimental. Final interbay spacing can be established by constructing scaled and/or full-sized prototypes and testing for spacings that either minimize mutual coupling over a desired band or establish a rate of improvement with increased distance that renders further increases unproductive. This consideration can be coordinated with effects of interbay spacing on beam tilt and null fill.

Figure 11:
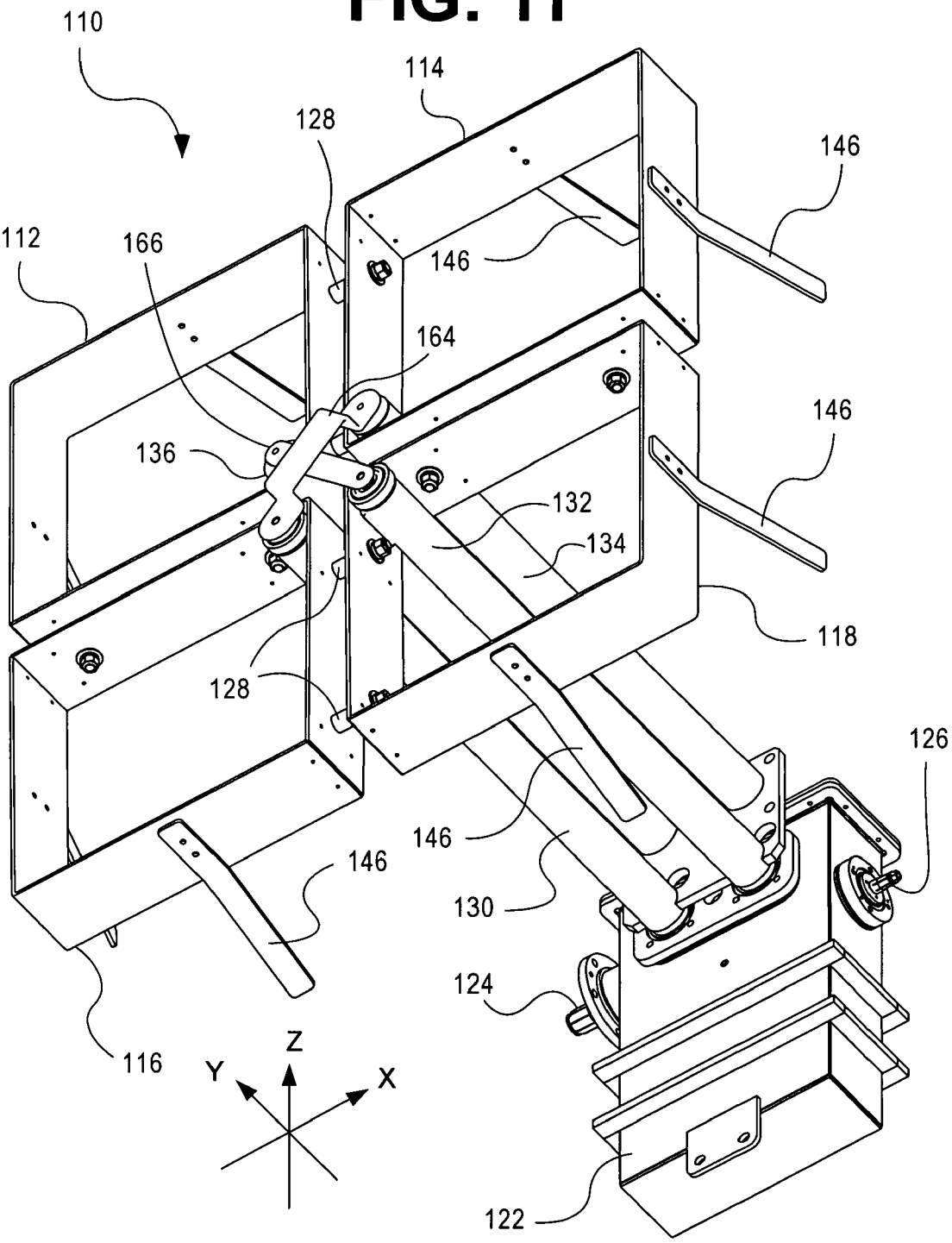
FIG. 11 is a perspective view of an antenna element and associated hybrid using the compensation method of FIG. 9.

A simple four-loop antenna element 110 such as that shown in FIG. 11 has a principal axis of propagation through the axis of rotational symmetry of the element 110, parallel to the Y axis, with propagation in the +Y and −Y directions being approximately equal for the embodiment shown. Each of the diagonal pairs of loops—112 and 118 form the first such pair, and 114 and 116 the second—receives a drive signal with equal and opposite excitation, fed through balun conductors 130 and 132 from a 90 degree signal hybrid 122. The hybrid 122 accepts a first excitation signal on a first input connector 124 and a second excitation signal on a second input connector 126.

The hybrid 122 can be contrasted with the one shown in FIG. 8, which is illustrated using a single signal path. In the hybrid 122 of FIG. 11, the inputs are coaxial lines (coaxes) and thus unbalanced, with the center conductors carrying signals and the outer conductors at ground. The outputs of the hybrid 122 include baluns—balanced-to-unbalanced line transformers—to effectively drive the loops with 3 dB splitting and 180 degree shifting on the zero-phase and 90-degree-phase outputs. The hybrid 122 outputs are controlled-impedance (unbalanced) coaxes 130 and 132, of which the outer conductors, as well as the outer conductors of the second coaxes 134 and 136, are shorted together proximal to the hybrid 122 case. The coaxes 130 and 132 preferably have the same characteristic impedance as the loop arrays, such as 50 ohms.

The center conductors of coaxes 130 and 132 are joined to crossing conductive straps 164 and 166, respectively. These straps are electrically and mechanically attached at their opposite ends to the outer conductors of the (optionally empty) second coaxes 134 and 136. Each of the four outer conductors 130, 132, 134, and 136 is electrically (and mechanically) joined to one of the loops 112, 118, 114, and 116 at the conductor ends farthest from the hybrid 122 case. Since the center conductors are excited with reference to their outer conductors, the ¼ wavelength distance from the outer conductor short at the hybrid 122 to the termination at the loops 112, 118, 114, and 116 allows the termination impedances of the outer conductors to exhibit the characteristic impedance of the coaxes, so that the loops are effectively equally and oppositely driven at their characteristic impedance over the working band. Thus, the combination of the hybrid 122 and the four coaxes 130, 132, 134, and 136 (the latter two lacking functioning center conductors) together provide two balanced outputs from two unbalanced inputs.

The balanced line outputs from the hybrid 122 drive the respective loops 112, 118, 114, and 116, with each input signal applied to one dipole (diagonally opposed pair of loops) at zero degrees and 180 degrees and the other dipole at 90 degrees and 270 degrees. The hybrid 122 outputs thus excite the loops in 0-90-180-270 sequence, so that antenna element 110 output from each of the inputs exhibits circular polarization that advances in one direction of rotation, and the two applied signals produce opposite circular polarization. Front-to-back properties are addressed below.

The nominal frequency range for antennas according to the instant invention is one in which skin effect is a significant phenomenon. As a consequence, it is to be understood that the behavior of the antenna components tends to be affected by depth of current penetration and by conductors behaving as factors affecting current flow. Thus, physical dimensions, coaxial line termination characteristics, and other details of implementation are likely to require analysis and testing to produce optimized devices. For example, the balun feed lines 130 and 132 may be connected to the loops 116 and 118 by positioning inside the loops and welding in some embodiments, but the signal paths will largely follow the insides of the coaxes 130 and 132 to the ends, then propagate over the affected loops (116 and 118 for the outer conductor signals, 112 and 114 for the inner conductor signals) from their respective distal surfaces outward over the loops and back down the outsides of the balun lines 130, 132, 136, and 134 to the termination (see also 190 in FIG. 16). The stripline hybrid couplers making up the proximal surfaces of adjacent loops require dimensioning consistent with this discussion, as validated by software modeling and prototype testing.

The relative positions of the loops in the embodiment shown in FIG. 11 are established in part by insulating spacers 128, preferably made from materials selected for low dissipation factor and acceptable long-term durability under weather stress. The spacers 128 shown use holes in the loop conductors to attach the spacers; in other embodiments, the spacer function can use wrap-around, clip-on, or other devices that provide comparable mechanical stabilization and electrical performance. In still other embodiments, element structural rigidity may be sufficient to obviate spacer use. With the possible exceptions of spacerless assemblies and assemblies using low-density foam spacers, spacer dielectric constants are likely to affect performance and require analysis and testing.

Figure 12:
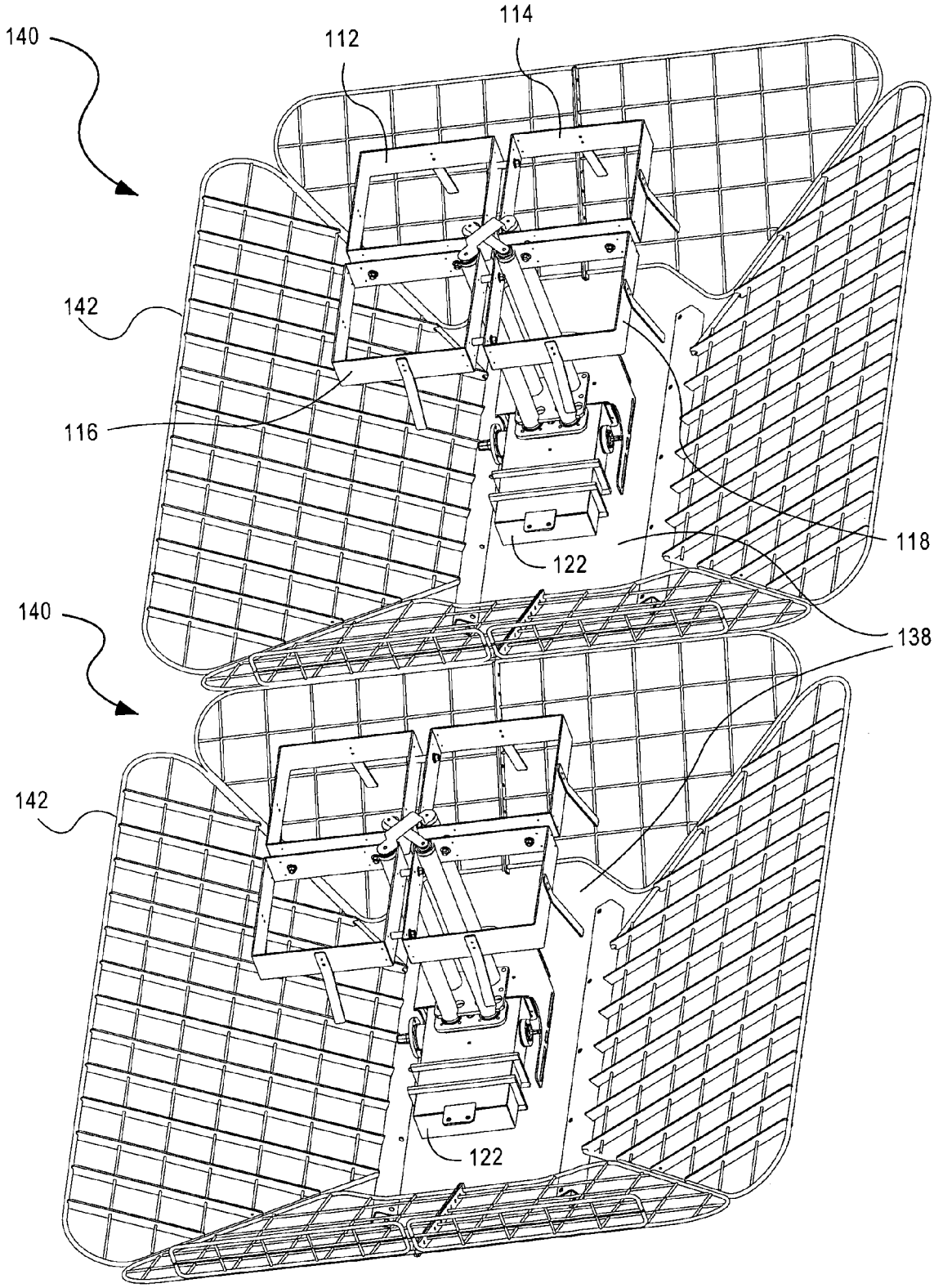
FIG. 12 is a perspective view of two antenna elements with reflectors realizing the compensation method of FIG. 9.

As seen in FIG. 12, four-loop antenna elements 140 can include conductive surfaces 142 that function as reflector components of the respective elements 140. The reflectors 142 cause signal energy that propagates from the loops 112, 118, 114, and 116 opposite to the desired direction of propagation (i.e., toward the hybrids 122) to be reflected by the short circuits of the reflectors 142 at a distance selected to cause the energy to return in phase with energy emitted later by the loops 112, 118, 114, and 116, reinforcing the forward signal and establishing an approximate single-lobe skull or cardioid pattern. The gaps 138 at the rear of the screen-type conductive surfaces 142 shown in FIG. 12 are closed in some embodiments by the structure of a conductive support strut or other mechanical component, while in other embodiments additional segments of screen may be positioned and connected to establish continuity. In still other embodiments, the components of the reflectors 142 may jointly form generally planar surfaces or may form curved surfaces rather than having the form of planar facets cupped around the loops 112, 118, 114, and 116 and the hybrids 122 as shown in FIG. 12. Interbay coupling between elements 140 may vary with reflector configuration. Tradeoffs between alternate reflector configurations are outside the scope of this disclosure.

Figure 13:
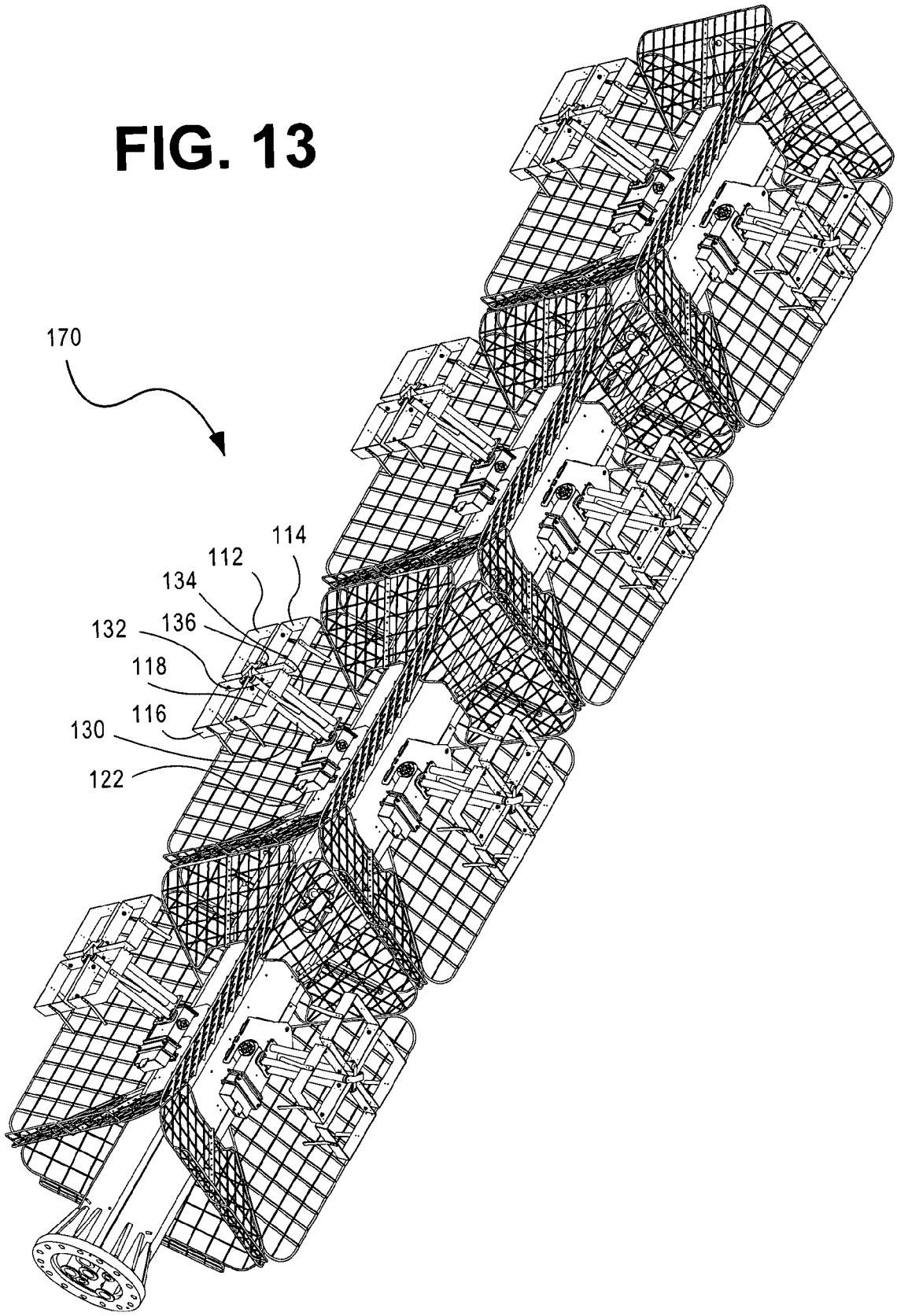
FIG. 13 is a perspective view of a four-bay antenna realizing the compensation method of FIG. 9.

As noted, the reflected signals have their polarization reversed, and are thus in phase with and reinforce signals emitted directly by the loops a half wave later. Some previous, single-phase (linear or circular) antenna installations employ the same principle; this permits some existing antenna installations that used reflector-backed radiators 140, such as a (tower-) top mounted "three around" style 170 (shown retrofitted with the radiators 112, 118, 116, 114 and associated balun 122 and feed lines 130, 132, 134, and 136 of the instant invention in FIG. 13) to be converted to support IBOC® operation by replacing the radiators and appropriately driving the replacement radiators. In other previous antenna designs, multiple reflector-equipped (also termed "cavity-backed") single-phase radiators are side-mounted at one or more azimuths on towers or other structures such as buildings (not shown) instead of the strut of FIG. 13; similar retrofitting for IBOC® operation is possible for these antennas. Such retrofitting may be desirable, for example, if analog propagation characteristics for radiators according to the instant invention are sufficiently similar to those of the original radiators to allow some testing or analysis to be waived, reducing regulatory burden.

In configurations wherein a plurality of elements according to the inventive apparatus and method are configured as a single bay—that is, at a single height, supported by and positioned around a center strut or a structure such as a tower, and pointing radially outward at intervals that may be radially uniform—far field signal strength can be sufficiently uniform with azimuth to be considered omnidirectional. Elements in a bay can be driven in synchronization, such as from a three-way power splitter for each of the analog and digital signals, or can be driven with signals that advance in phase around the bay, such as by 360/n degrees for n equally displaced elements. Such arrangements can provide acceptable uniformity of signal strength with azimuth. If a plurality of bays, each having a plurality of elements at a single elevation, are sufficiently isolated by vertical spacing, then drive timing and vertical spacing from bay to bay can be selected to achieve desired gain and/or beam tilt, and the assembly can operate as a single omnidirectional broadcast antenna. If all of the elements of all of the bays emit signals from both an analog source and a digital source, and the two emitted signals have opposite handedness of circular polarization and have relative signal strength complying with applicable FCC regulations, the antenna is IBOC® compatible.

Returning to FIG. 11, the lengths of the balun conductors 130, 132, 134, and 136 leading from the hybrid 122 to the loops 112, 118, 114, and 116 are selected to optimize impedance matching. The point at which the balun conductors 130, 132, 134, and 136 connect to the respective loops 112, 118, 114, and 116 is shown as the closest point of convergence of the four loops. Since diagonal pairs of loops form the two crossed dipoles and are preferably driven with equal and opposite signals, the configuration of FIG. 11 affords impedance error and phase error in the loop connections that are relatively low, while the attachment of the respective balun conductors 130, 132, 134, and 136 to the respective loops 112, 118, 114, and 116 can provide a mechanically robust assembly. In some embodiments, loop-to-conductor connection may differ at least in the configuration of the feed straps 164 and 166 from the center conductors to the opposite monopoles. The embodiment in FIG. 11 has been shown to combine satisfactory impedance matching with acceptable voltage isolation and simple manufacture.

In the embodiment shown in FIG. 11, the input connectors 124 and 126 to the hybrid 122 differ in size. The larger connector 124 is capable of carrying higher power associated with analog FM transmission, while the smaller is adequate in size to carry the small digital signal for IBOC® (20 dB down, or 1/100 of the power of the analog signal), and both are sufficiently mechanically robust to withstand environmental stresses.

Figure 15:
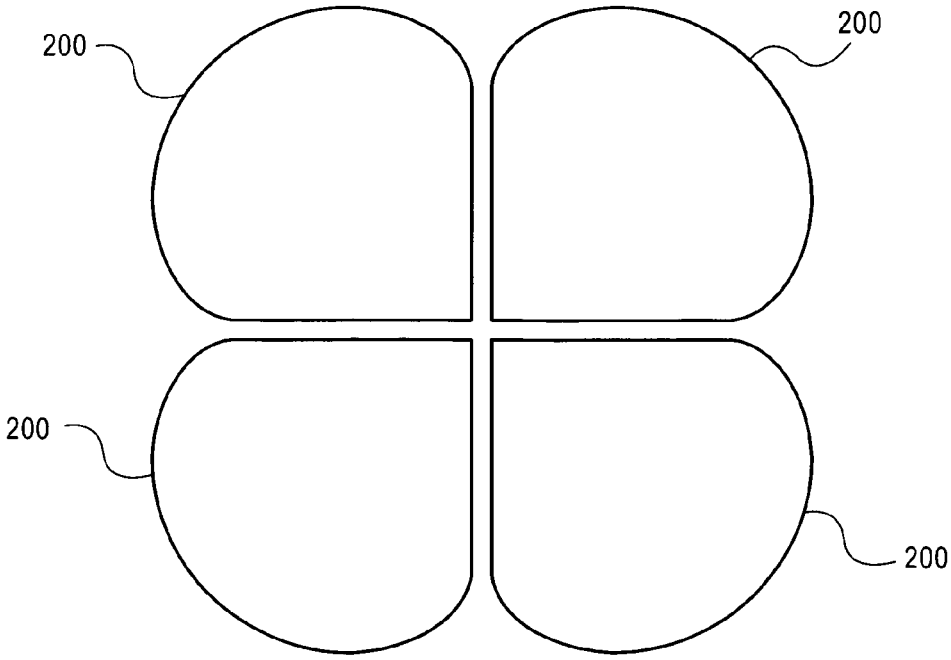
FIG. 15 is a view showing an alternative loop profile.

The loops 112, 118, 114, and 116 are shown as square, a shape shown by experiment to produce satisfactory performance, and bent and/or welded from rectangular-section aluminum bar stock. Other materials, such as copper, copper-clad aluminum, silver-plated copper, and metal-clad fiber-reinforced epoxy (i.e., circuit board material), as well as others, and other shapes, such as hollow extrusions and elliptical or cylindrical conductor stock, as well as others, may be appropriate for some embodiments, provided electrical performance and structural integrity are acceptable for the intended environment and power level. In the embodiments shown in FIGS. 11, 12, and 13, all loop edges are straight and loop surfaces substantially flat, with small radii of curvature at transitions; in other embodiments, curvature may be more gradual, and edges may be arcuate or may otherwise differ from the straight lines shown. In still other embodiments, as shown in FIG. 15, the outer portions of the loops 200 may have a shape other than square. Such a shape preferably retains a perimeter propagation length of roughly a half wavelength in the environment shown, approximately the free-space length, as well as potentially having tuning barbs as discussed below. In all such embodiments, electrical interaction between the component elements of the loops 112, 118, 114, and 116 conforms substantially to the stripline hybrid model.

Figure 16:
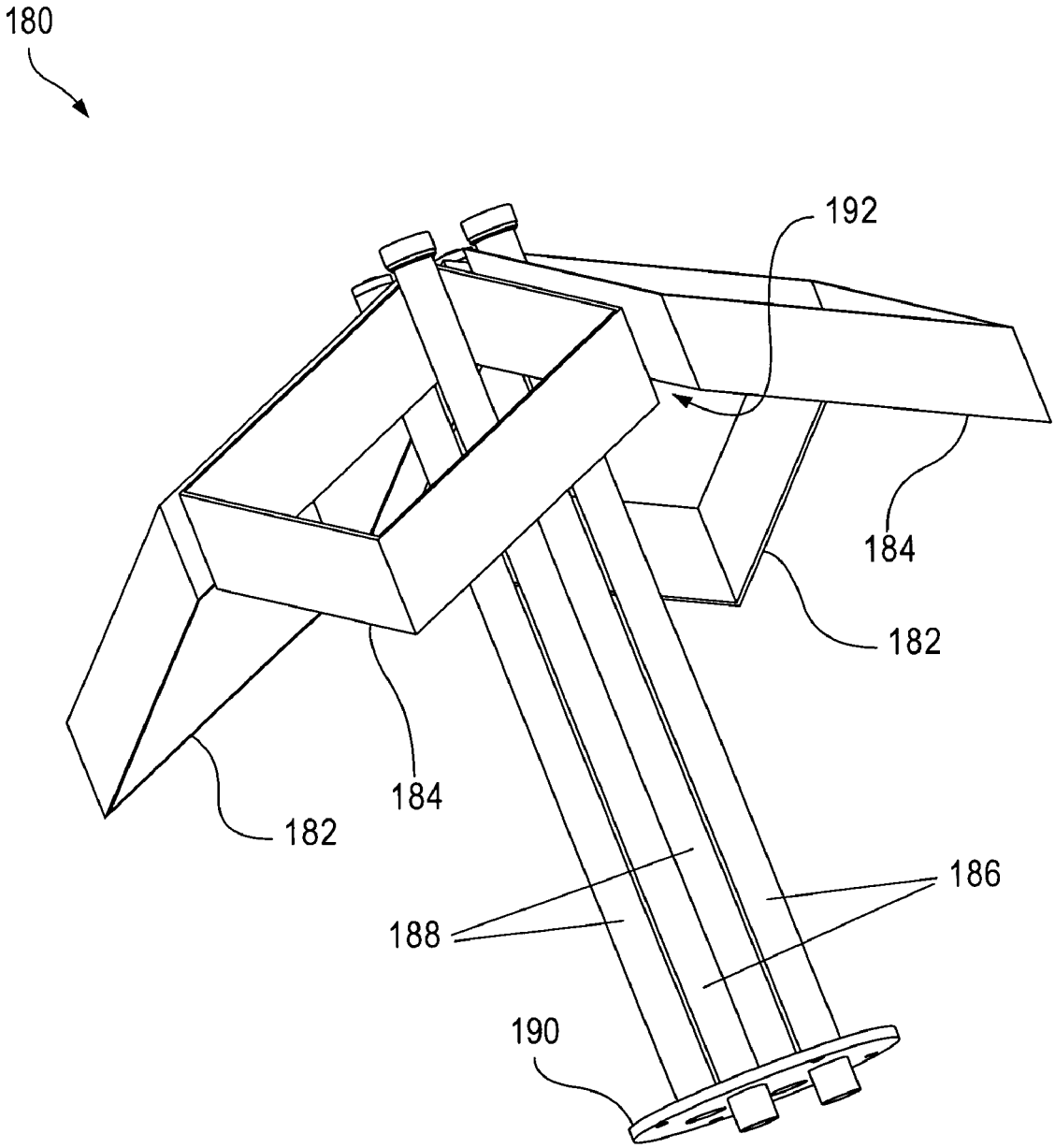
FIG. 16 is a view showing an alternative loop face extent.

The embodiment 180 shown in FIG. 16 uses, as a distal extent of the monopole radiators 182 and 184 with respect to the hybrid (only the lines from the hybrid for signal feeds 186 and matching stubs 188 are shown) and the reflector (not shown, but may be positioned in some embodiments approximately in the plane of the feed line joining plate 190), a pyramidal (faceted, symmetrical, convex) surface. An experimental version of this embodiment has been built and tested; each of the monopoles 182 and 184 was fashioned and positioned so that a pyramidal surface formed the distal extent of the radiator, with the apex also the point of intersection between the pyramidal surface and the axis of rotational symmetry of the radiator. This experimental embodiment exhibited narrower bandwidth but wider beamwidth than the planar embodiment of FIG. 11. Antennas built with nonplanar, regular radiators may be expected to exhibit superior azimuth uniformity, over a range of deviation from planarity, possibly at a cost of reduced broad-band capability.

Still other embodiments, using, for example, a curved cylindrical surface of distal extent, or a surface of distal extent in which sets 182 and 184 of upper and lower monopoles are coplanar within each set but tilted away from other sets to form a prism in each bay, may retain the noted azimuth improvement at least in part, with less sacrifice in bandwidth. In typical embodiments of these sorts, fabrication may be somewhat more complex, as individual piece parts no longer meet at simple angles and may no longer be rectilinear, instead being rolled "hard way," cut from larger pieces of stock, or the like, and potentially requiring jigs, welding, and considerable finishing instead of basic bending to form the individual monopoles. If the spacing between the (not necessarily planar) faces of the monopoles is substantially uniform, the performance of slots 192 between monopoles as stripline hybrids configured to provide low cross coupling may remain acceptable. Any nonuniformity of section along the perimeter of an individual monopole may affect current density, and thus alter performance.

Other approaches to multiple-monopole antenna design, such as the circularly-polarized radiators for single signals of Woodward, U.S. Pat. No. 4,184,163, issued Jan. 15, 1980, and of Woodward et al., U.S. Pat. No. 4,510,501, issued Apr. 9, 1985, associate their respective monopoles using less well defined couplers. Couplers according to these patents may be proximal cylindrical rods formed into coplanar rings, or may be parallel cylindrical rods or the like. Such couplers, developed using alternative theories of operation and thus having weakly specified electrode interaction, cannot assure cancellation of cross-coupling within each radiator, and lack a conceptual basis for cancellation of mutual coupling between bays. When modified to accommodate dual-signal operation, for example by combining with Stenberg, U.S. Pat. No. 6,934,514, issued Aug. 23, 2005, such couplers cannot overcome the deficiencies characteristic of other known art, as described in the Background.

FIG. 11 further illustrates tuning barbs 146 added to the signal hybrid-side loop faces and projecting toward the reflectors 142 shown in FIG. 12. The tuning barbs 146 permit fine tuning of the loops 112, 118, 114, and 116. As is well known in the art, a first conductor, such as a loop edge, having a length parallel to a second conductor, such as a ground plane, and conducting a radio-frequency electromagnetic (EM) signal, has a value of distributed impedance with respect to the second conductor determined by the physical dimensions and properties of the two conductors and the dielectric between. Any irregularity in the spacing between the first and second conductors (the argument applies symmetrically to the second conductor) causes an impedance lump—capacitive in the case of a protrusion—affecting the propagation of the signal as well as causing a reflection proportional to the magnitude of the impedance lump.

The loops 112, 118, 114, and 116 can be equipped with one or more tuning barbs 146 protruding toward the ground plane 142, shown in FIG. 12. Where properly chosen for length and position, barbs 146 can increase the electrical lengths of loop faces made undersize, bringing the loops arbitrarily close to the 135 degree hybrid condition for the frequency band for which the antenna element 140 is intended. Barbs 146 tend to further broaden element bandwidth, reducing tuning sharpness, which can be useful in broadband applications, such as in antennas for broadcasting multiple VHF channels. As in the case of the loop dimensions, tuning barb 146 number, section, length, position along the loops, and orientation ultimately require experimental confirmation. Rotational symmetry—that is, positioning of tuning barbs 146 at uniform positions around the four-component element as in FIGS. 11 and 12, for example—has been shown to support low realized cross coupling and mutual coupling in some embodiments.

Signal power applied to an antenna using the instant invention can be distributed to the individual radiative components in several ways. Signals radiated from the antenna are preferably synchronous—emitted in a fixed phase relationship for all analog signals and in a separate, likewise fixed phase relationship for all digital signals. The signals within a bay are viewed as synchronous if they are either substantially simultaneous, so that signals at all azimuths are in phase, or if the signal timing propagates around the antenna, with each hybrid receiving a signal delayed by 360/n degrees, for n equal to the number of elements in each bay. The signals to the respective bays are viewed as synchronous if they are delayed by zero, one, or more cycles of the center frequency for the antenna.

In a first configuration, corporate (branch) feed can use a single transmission feed line each for analog FM and digital OFDM to a midpoint of the antenna, where the feeds can each be split by a first splitter into as many signals as there are bays. Power, delivered by equal-length coaxes to additional splitters, typically at each bay, can be coax-coupled from these splitters to individual-element hybrids. Another approach splits the respective signals into three, for example, for a three-around design, using a three-way power splitter with high timing accuracy, then runs three large and three small coaxes up the antenna, with a simple tee connection at each level to tap off power for the element hybrid at that level. Still another approach uses a single coax each for the analog and digital signals and provides one tap and one splitter for every one (three-way) or two (six-way) bays.

Beam tilt adjusts drive timing to each bay so that the main beam is not perpendicular to the tower axis. For terrestrial broadcasting from elevated sites, it may be desirable to have some downward tilt, uniform with azimuth, which is readily realized by altering bay spacing or adjusting the feed to successive bays to be delayed by an amount different from one cycle of the antenna center frequency. Since bay spacing for antennas according to the instant invention is selected to provide a usefully low degree of mutual coupling and is thus not nominally one wavelength, further adjustment in bay-to-bay spacing and/or feed timing to realize beam tilt may not incur technical risk. Similarly, properly selected nonuniform bay-to-bay spacing can provide null fill (that is, reduce a downward-directed secondary beam and an adjacent null in signal strength), enhancing short-range performance.

Figure 14:
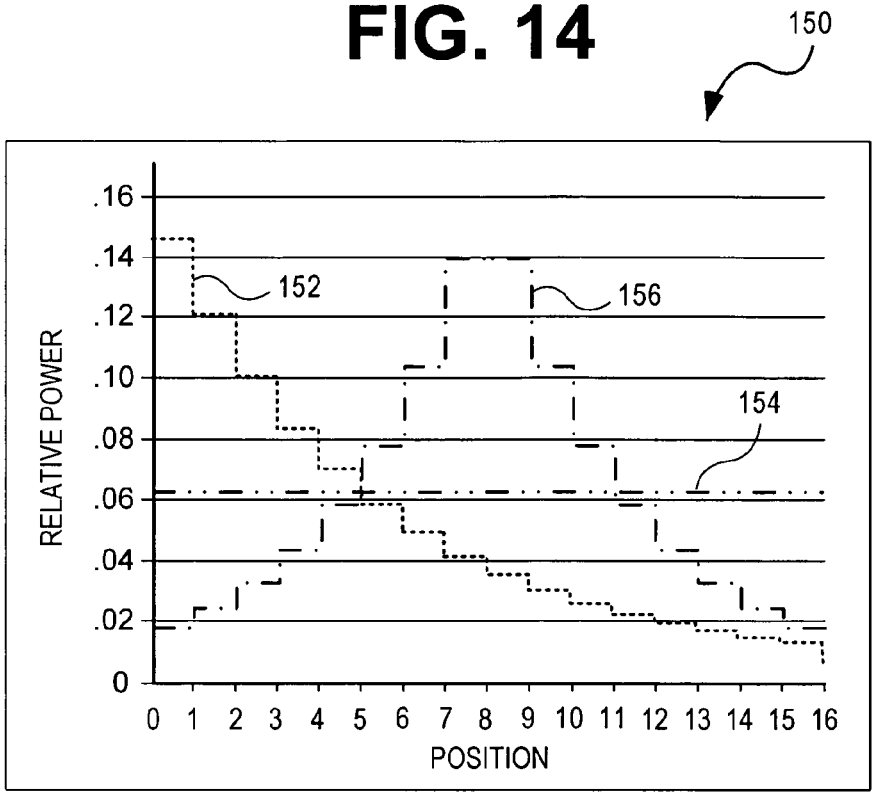
FIG. 14 is a comparative power chart for alternate coupling schemes.

FIG. 14 shows plots 150 of representative power distribution arrangements for a 16-bay antenna. Signal levels driving successive bays may be uniform in some embodiments but not others. The following assumes corporate feed—that is, multiple-way power splitters with feed coaxes to each bay and subordinate splitters to the analog and digital hybrid ports in the bays—but is realizable with other embodiments. For some splitters 152, each output receives a percentage of the power remaining after prior outputs, so that bays further from the bottom, for example, may emit successively less radiated signal. For other splitters 154, each output can provide a substantially equal amount of power to each bay. For still other splitters 156, specific coupling to each output can be tailored, such as with the highest output going to the center bays as shown. Each such approach can produce a somewhat different beam pattern, extent of beam tilt and null fill, and other effects, and may be preferable for specific embodiments.

Antennas employing the instant invention as disclosed herein substantially eliminate cross coupling between dipoles within each element and further substantially eliminate mutual coupling between vertically spaced bays. Similar, opposite-handed, circularly polarized propagation patterns can be achieved for two signals driven on separate inputs, wherein the signals can be the respective analog and digital signals of an IBOC® transmission system. Tuning barbs can provide final adjustment to a configuration. Previous circularly- or horizontally-polarized antenna products such as the top mounted three-around "FMVee" (go to Dielectric Communications website, www.dielectric.com, click "RF" and "Radio Antennas and RF Products", then scroll to page 4 (sheet 5) of the PDF document) and the side mounted cavity-backed radiator "CBR" (page 8 (sheet 9) of the same document) can be readily converted to combined systems supporting In-Band, On-Channel analog/digital operation with the replacement of their previous radiators by radiators according to the instant invention, adding OFDM signal feed. Where the change in radiators leaves the FM ERP and propagation pattern substantially unchanged, it may be possible to upgrade to IBOC® without full-blown FCC recertification.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A two-port electromagnetic signal broadcasting antenna, comprising:

a first radiating element comprising:

four discrete conductive loops; and at least one tuning barb, conductively attached to at least one of the four discrete conductive loops, electrically and chemically compatible with the structure of the loop to which the tuning barb is attached;

a hybrid coupler having a first unbalanced input port and a second unbalanced input port, and having a first balanced output port and a second balanced output port, wherein the respective balanced output ports have respective output signal conductor arrangements configured to supply substantially equal and opposite signals from the hybrid coupler to a balanced load; and electrical connections between the first radiating element and the respective output signal conductors of the hybrid coupler, wherein points of connection between the first radiating element and conductors are substantially symmetric about the rotational axis of symmetry of the first radiating element arrangement.

2. The antenna of claim 1, wherein the first radiating element further comprises a reference surface whereon lie perimeters of the four loops, with each loop comprising four conductive, substantially uniform faces, with adjacent faces of each loop joined electrically and mechanically at substantially square comers, with proximal faces of proximal loops substantially parallel and coextensive, with distances between proximal faces of proximal loops substantially equal and selected for low cross coupling, with each proximal face lying in a plane substantially orthogonal to the reference surface, and with the arrangement of the loops configured with fourfold rotational symmetry about an element axis perpendicular to the reference surface.

3. The antenna of claim 1, wherein the first radiating element further comprises a substantially continuously conductive surface configured as a reflector, wherein the reflector is spaced away from the loops in a direction opposite to a first major lobe of radiation of the first radiating element by an effective distance of approximately one quarter wavelength.

4. The antenna of claim 3, further comprising at least one additional element, substantially similar to the first element, positioned with an element axis of rotational symmetry substantially coplanar with, equidistant from an antenna base with, and intersecting the element axis of rotational symmetry of the first element, wherein elements having substantially coplanar, antenna-base equidistant, and intersecting element axes of rotational symmetry jointly comprise a first bay, and wherein elements comprising the first bay are configured with distributed azimuthal orientation about a vertical antenna axis.

5. The antenna of claim 4, further comprising:

a first power divider configured to accept bay signal energy from a first signal source and to distribute that first-source signal energy to respective first signal input ports of respective hybrid couplers of elements in a bay of the antenna; and a second power divider configured to accept bay signal energy from a second signal source and to distribute that second-source signal energy to respective second-signal input ports of respective hybrid couplers of elements in a bay of the antenna.

6. The antenna of claim 5, further comprising at least one additional bay, comprising in conjunction with the first bay a plurality of bays, wherein the at least one additional bay comprises:

a plurality of elements substantially identical to corresponding elements of the first bay, wherein elements comprising the at least one additional bay are equal in number to the elements of the first bay, are vertically aligned with respective elements of the first bay, have element axes of rotational symmetry that are substantially horizontal, coplanar, and intersecting, and have vertical displacement between element axis planes of proximal bays selected to establish a selected level of mutual coupling between respective elements in the proximal bays over a specified range of frequencies within the antenna frequency band.

7. The antenna of claim 5, further comprising at least one additional bay, jointly comprising a plurality of bays, wherein the at least one additional bay comprises: a plurality of elements substantially identical to corresponding elements of the first bay, wherein elements comprising the at least one additional bay are equal in number to the elements of the first bay, are vertically aligned with respective elements of the first bay, have element axes of rotational symmetry that are substantially horizontal and coplanar, and have vertical displacement between respective element axis planes of the plurality of bays selected to establish a selected combination of mutual coupling, beam tilt, and null fill.

8. The antenna of claim 5, further comprising at least one additional bay, jointly comprising a plurality of bays, wherein the at least one additional bay comprises:

a plurality of elements substantially identical to corresponding elements of the first bay, wherein elements comprising the at least one additional bay are equal in number to the elements of the first bay, are vertically aligned with respective elements of the first bay, have element axes of rotational symmetry that are substantially horizontal, coplanar, and intersecting, and have vertical displacement between element axis planes of proximal bays selected to establish a low level of mutual coupling over a range of frequencies within the antenna frequency band;

an analog power divider and associated conductors for distribution of analog signal power to bays, whereby each bay of a plurality of bays receives an analog FM VHF broadcast signal at a time interval substantially equal to m cycles of a reference frequency within the VHF broadcast band after the signal is received by a reference bay, for m an integer having a value of at least zero with respect to a reference time; and a digital power divider and associated conductors for distribution of digital signal power to bays, whereby each bay of a plurality of bays receives a digital OFDM VHF broadcast signal at a time interval substantially equal to n cycles of the reference frequency after the digital signal is received by the reference bay, for n an integer having a value of at least zero with respect to the reference time.

9. The antenna of claim 5, further comprising at least one additional bay, jointly comprising a plurality of bays, wherein the at least one additional bay comprises:

a plurality of elements substantially identical to corresponding elements of the first bay, wherein respective elements comprising the at least one additional bay are equal in number to the elements of the first bay, are vertically aligned with respective elements of the first bay, have element axes of rotational symmetry that are substantially horizontal and coplanar, and have vertical displacement between element axis planes of proximal bays selected to establish a low level of mutual coupling;

a first-broadcast-signal power divider and associated conductors for distribution of first-signal power to bays, wherein the first-broadcast-signal power applied to each bay has it relative signal power level proportional to the position of each bay with respect to a reference bay, and wherein the relative power level of the first-broadcast-signal power applied to each bay is selected from a group consisting of decreasing with increasing distance of a bay from a reference bay at a lowest vertical position of the antenna, remaining constant with distance from a reference bay at the lowest vertical position of the antenna, and decreasing with increasing distance of a bay from a reference bay proximal to a vertical midpoint of the antenna; and a second-broadcast-signal power divider and associated conductors for distribution of second-signal power to bays, wherein the second-broadcast-signal power to each bay has a relative signal power level proportional to the position of each bay with respect to a reference bay, and wherein the second-broadcast-signal power applied to each bay has a relative signal power level proportional to the first-broadcast-signal power applied to the same bay.

10. The antenna of claim 1, wherein tuning barb size, position, and orientation are selected to increase, to a measurable extent, an electrical length of the loop to which the tuning barb is connected.

11. The antenna of claim 1, further comprising a plurality of insulating spacers configured to establish stable and uniform distances between proximal loop faces.

12. The antenna of claim 1, wherein the hybrid coupler further comprises:

a first signal coaxial input port with a first input impedance, configured to accept at least a first unbalanced electromagnetic signal, wherein the first electromagnetic signal is compliant with FCC requirements for broadcast signals, and has a center frequency within the antenna frequency band;

a second signal coaxial input port with a second input impedance, configured to accept at least a second unbalanced electromagnetic signal, having a center frequency substantially equal to the center frequency of the first electromagnetic signal;

a first balanced output port configured to emit as an output a first half of the first input signal with a first-signal zero reference phase delay, and further configured to emit as an output a first half of the second input signal with a phase delay substantially equal to 90 degrees with respect to a second-signal zero phase reference, wherein the first output port provides a positive output signal and a negative output signal with reference to the input signals, and wherein the instantaneous phase differences between the respective positive and negative output signals are each substantially equal to 180 degrees; and a second balanced output port configured to emit as an output a second half of the first input signal with a phase delay substantially equal to 90 degrees with respect to the first-signal zero phase reference, and further configured to emit as an output a second half of the second input signal with a second-signal zero reference phase delay, wherein the second output port provides a positive output signal and a negative output signal with reference to the input signals, and wherein the instantaneous phase differences between the respective positive and negative output signals are each substantially equal to 180 degrees.

13. The antenna of claim 12, wherein the first balanced output port and the second balanced output port further comprise electrical contact nodes providing output signals with respective output impedances that are substantially equal.

14. The antenna of claim 13, wherein the respective nodes provide substantially equal phase delay from balanced output port signal conductors to respective loop connections.

15. The antenna of claim 1, wherein the hybrid coupler further comprises:

a first coaxial signal input port with a specified input impedance, configured to accept at least one unbalanced, frequency-modulated (analog FM) electromagnetic signal with a center frequency in a specified channel within the VHF broadcast band, wherein the analog FM signal complies with FCC requirements for broadcast power level and spectrum mask for that FCC channel license; a second coaxial signal input port with a specified input impedance, configured to accept at least one unbalanced, orthogonal frequency division multiplexed (OFDM) electromagnetic signal, wherein the OFDM signal complies with FCC requirements for in-band, on-channel transmission using the same channel as the at least one analog FM signal;

a first balanced output port configured to emit as an output a first half of the analog FM input signal with an FM zero reference phase delay, and further configured to emit as an output a first half of the OFDM input signal with a 90 degree phase delay with respect to an OFDM zero phase reference, wherein the output port provides a positive output signal and a negative output signal with reference to the input signals, and wherein the instantaneous phase differences between the respective positive and negative output signals are each substantially equal to 180 degrees; and a second balanced output port configured to emit as an output a second half of the analog FM input signal with a 90 degree phase delay with respect to the analog FM zero phase reference, and further configured to emit as an output a second half of the OFDM input signal with an OFDM zero reference phase delay, wherein the output port provides a positive output signal and a negative output signal with reference to the input signals, and wherein the instantaneous phase differences between the respective positive and negative output signals are each substantially equal to 180 degrees.

16. An antenna, comprising:

a first dipole comprising two first monopoles;

a second dipole comprising two second monopoles, wherein the two first monopoles are coupled with the two second monopoles using stripline hybrid couplers, wherein component elements comprising the stripline hybrid couplers are integral with the respective monopoles, and wherein the two dipoles form a crossed dipole radiator; and at least one tuning barb, conductively attached to at least one of the first or second monopoles, electrically and chemically compatible with the structure of the first or second monopole to which the tuning barb is attached.

17. The antenna of claim 16, wherein the first dipole and the second dipole have a common center, are substantially dimensionally equal, are conductively isolated from each other, and have respective dipole axes that are coplanar and are substantially at right angles to each other and to a principal axis of propagation of the antenna.

18. The crossed dipole radiator of claim 16, wherein each monopole of the respective dipoles comprises a conductive, closed loop.

19. The antenna of claim 16, further comprising:

a feed hybrid coupler comprising first and second unbalanced input ports and first and second balanced output ports, wherein the feed hybrid coupler is configured to accept, on the respective input ports, two signals having a common channel, and to provide, on the respective output ports, a first balanced output signal consisting of the first signal at approximately half power with a default first-signal phase and the second signal at approximately half power with a phase delay of approximately a quarter-cycle after a default second-signal phase, coupled to the first dipole, and a second balanced output signal consisting of the second signal at approximately half power with a default second-signal phase and the first signal at approximately half power with a phase delay of approximately a quarter-cycle after a default first-signal phase, coupled to the second dipole.

20. A two-port electromagnetic signal broadcasting antenna, comprising:

means for radiating two circularly polarized signals within a frequency band with orthogonal polarization, wherein the means for radiating emits signals having advancing orientation of signal polarization angles over time, with a first rotational direction of advance for the first signal and a second, reversed, rotational direction of advance for the second signal, wherein the means for radiating exhibits low cross coupling between elements comprising the means for radiating;

means for coupling source signals from two unbalanced inputs to two balanced outputs, wherein the means for coupling directs a first unbalanced signal from a first coaxial feed port to a first coaxial output port with a first reference delay and to a second coaxial output port with a delay exceeding the first reference delay by approximately one quarter cycle of a broadcast frequency, and wherein the means for coupling directs a second unbalanced signal from a second coaxial feed port to the second coaxial output port with a second reference delay and to the first coaxial output port with a delay exceeding the second reference delay by approximately one quarter cycle of a broadcast frequency;

means for conductively connecting the balanced outputs of the means for coupling to the elements comprising the means for radiating; and at least one tuning barb, conductively attached to at least one of the elements, electrically and chemically compatible with the structure of the element to which the tuning barb is attached.

21. A method for broadcasting orthogonal circularly polarized electromagnetic signals, comprising:

providing a first signal and a second signal for application to a two-port broadcasting antenna, wherein the first signal comprises an analog FM VHF signal having broadcast amplitude and a specified channel frequency, wherein the second signal comprises a digital OFDM signal configured to permit cofunctioning with the analog FM VHF signal to provide emission that conforms to the standards of the in-band, on-channel specification;

dividing each of the first and second signals into two substantially equal energy portions, wherein each signal has an energy portion with a zero reference phase, and wherein each signal has an energy portion with a phase lag that is approximately ninety degrees greater than the zero reference phase; combining a zero reference phase energy portion of one of the signals and a ninety degree lag portion of the other signal to form a first balanced output and the remaining portions to form a second balanced output;

configuring orthogonal, coplanar first and second crossed dipoles with cross coupling-suppressing hybrid coupling between each monopole of the first dipole and each monopole of the second dipole; and applying the first and second balanced outputs to the respective dipoles, wherein at least one tuning barb is conductively attached to at least one monopole of the first or second dipole, and is electrically and chemically compatible with the structure of the monopole to which the tuning barb is attached.

22. The method of claim 21, further comprising:

emitting the first signal in two portions, wherein a first portion thereof has a first circular polarization, and propagates in a first principal direction of propagation, orthogonal to respective axes of the dipoles, and wherein a second portion thereof has a second, opposite circular polarization, and propagates in a second principal direction of propagation, opposite to the first principal direction of propagation;

emitting the second signal in two portions, wherein a first portion thereof has a first circular polarization, opposite to the polarization of the first portion of the first signal, and propagates in the direction of the first portion of the first signal, and wherein a second portion thereof has a second, opposite circular polarization, and propagates in the direction of the second portion of the first signal; and reflecting the signal portions propagating in the second principal direction, wherein a direction of reflection substantially coincides with the first principal direction, wherein the reflected signal portions arriving back at a plane of the monopoles reinforce the instantaneous signal propagating in the first direction.

23. The method of claim 21, wherein the balance outputs applied to the dipoles are carried on coaxial conductors electrically joined proximal to an output node at which the first and second signals are combined, wherein the coplanar dipoles are configured as square, open loops, and wherein two adjoining faces of each of the loops are parallel to and separated from faces of two other loops with a spacing configured to form hybrid couplers that establish low cross coupling between the dipoles.

* * * * *